US010626589B2

(12) United States Patent
Yamasaki et al.

(10) Patent No.: US 10,626,589 B2
(45) Date of Patent: Apr. 21, 2020

(54) FLUSH TOILET

(75) Inventors: Yu Yamasaki, Fukuoka (JP); Masaaki Inoue, Fukuoka (JP); Masahiro Nakamura, Fukuoka (JP)

(73) Assignee: TOTO LTD., Fukuoka (JP)

( * ) Notice: Subject to any disclaimer, the term of this patent is extended or adjusted under 35 U.S.C. 154(b) by 128 days.

(21) Appl. No.: 13/588,573

(22) Filed: Aug. 17, 2012

(65) Prior Publication Data

US 2013/0047329 A1 Feb. 28, 2013

(30) Foreign Application Priority Data

Aug. 24, 2011 (JP) ..... 2011-182899

(51) Int. Cl.
*E03D 11/02* (2006.01)

(52) U.S. Cl.
CPC ..... *E03D 11/02* (2013.01); *E03D 2201/40* (2013.01)

(58) Field of Classification Search
CPC ..... E03D 11/02; E03D 11/08; E03D 11/18; E03D 2201/30; E03D 2201/40
USPC ..... 4/420, 421, 425, 345
See application file for complete search history.

(56) References Cited

U.S. PATENT DOCUMENTS 2,158,362 A * 5/1939 Groeniger ..... 4/425
5,918,325 A 7/1999 Arita et al.
6,145,138 A * 11/2000 Nakamura ..... E03D 11/02 4/420
7,661,153 B2 * 2/2010 Nakamura et al. ..... 4/420
7,827,628 B2 * 11/2010 Ichiki et al. ..... 4/420
8,151,379 B2 * 4/2012 Mueller et al. ..... 4/420
2004/0040080 A1 * 3/2004 Prokopenko et al. ..... 4/420
2006/0005310 A1 1/2006 Nakamura et al.
2007/0061955 A1 * 3/2007 Asada et al. ..... 4/425
2007/0277302 A1 12/2007 Ichiki et al.
(Continued)

FOREIGN PATENT DOCUMENTS

CN 101115887 A 1/2008
DE 92 16 494 U1 1/1993
GB 935949 A 9/1963
(Continued)

OTHER PUBLICATIONS

JP2007314975 Translation.*
(Continued)

*Primary Examiner* — Benjamin R Shaw
(74) *Attorney, Agent, or Firm* — Studebaker & Brackett PC

(57) ABSTRACT

A flush toilet comprises a bowl portion including a waste receiving surface, a rim portion formed on the top edge portion thereof so that inner circumferential surface thereof rises essentially vertically, and a shelf portion formed between the rim portion and the waste receiving surface; a water spouting portion for spouting flush water onto the shelf portion to form a swirl flow; and a water conduit for supplying the flush water to the spouting portion. The water spouting portion is formed in the front region of the bowl portion, and a part of the inner circumferential surface of the rim portion is formed in an inward-facing overhanging shape; and the water spouting portion is covered by the overhanging part of the rim portion such that a user cannot observe the water spouting portion when viewing from diagonally forward and above the bowl portion.

6 Claims, 12 Drawing Sheets

(56) References Cited

U.S. PATENT DOCUMENTS

| | | | | |
|---|---|---|---|---|
| 2008/0276361 | A1* | 11/2008 | Mueller et al. | 4/420 |
| 2011/0023224 | A1 | 2/2011 | Ichiki et al. | |

FOREIGN PATENT DOCUMENTS

| | | | | | |
|---|---|---|---|---|---|
| GB | 2045311 | A | * | 10/1980 | E03D 11/02 |
| JP | H06-299587 | A | | 10/1994 | |
| JP | 2000265525 | A | * | 9/2000 | |
| JP | 2001279788 | A | * | 10/2001 | |
| JP | 2005-098003 | A | | 4/2005 | |
| JP | 2005-113643 | A | | 4/2005 | |
| JP | 2007-308912 | A | | 11/2007 | |
| JP | 2007308912 | A | * | 11/2007 | |
| JP | 2007314975 | A | * | 12/2007 | |
| JP | 2010-180587 | A | | 8/2010 | |
| JP | 2010-236320 | A | | 10/2010 | |
| JP | 2011-157738 | A | | 8/2011 | |
| TW | 209518 | U | | 7/1993 | |

OTHER PUBLICATIONS

JP 2007308912 A Translation.*
JP2000265525A Translation.*
JP2001279788A Translation.*
The extended European Search Report dated Dec. 21, 2012, which corresponds to EP Application No. 12179753.4-2315 and is related to U.S. Appl. No. 13/588,573.
An Office Action issued by the Japanese Patent Office dated Jan. 28, 2015, which corresponds to Japanese Patent Application No. 2011-182899 and is related to U.S. Appl. No. 13/588,573; with English language partial translation.
An Office Action; "Notice of Reasons for Rejection," issued by the Japanese Patent Office dated Aug. 26, 2015, which corresponds to Japanese Patent Application No. 2011-182899 and is related to U.S. Appl. No. 13/588,573; with English language partial translation.
The first Office Action issued by the State Intellectual Property Office of the People's Republic of China dated Sep. 12, 2014, which corresponds to Chinese Patent Application No. 201210258017.8 and is related to U.S. Appl. No. 13/588,573; with English language partial translation.
An Office Action issued by the Taiwanese Patent Office dated Jun. 16, 2016, which corresponds to Taiwanese Patent Application No. 101108301 and is related to U.S. Appl. No. 13/588,573.
An Office Action mailed by the European Patent Office dated Mar. 23, 2018, which corresponds to European Patent Application No. 12179753.4-1002 and is related to U.S. Appl. No. 13/588,573.
An Office Action published by the Brazilian Patent and Trademark Office dated Sep. 24, 2019, which corresponds to Brazilian Patent Application No. 102012021115-7 and is related to U.S. Appl. No. 13/588,573.
An Office Action issued by the Indian Patent Office dated May 20, 2019, which corresponds to Indian Patent Application No. 2592/DEL/2012 and is related to U.S. Appl. No. 13/588,573.

* cited by examiner

FLUSH TOILET

TECHNICAL FIELD

The present invention relates to a flush toilet, and in particular to a flush toilet for discharging waste using flush water supplied from a flush water supply source.

BACKGROUND ART

As shown in Japanese patent unexamined publication 2005-98003 (patent document 1), a conventional flush toilet for discharging waste by flushing the toilet with flush water is known. In the conventional toilet, the inner circumference of a rim portion formed at the top edge of the bowl portion of the flush toilet is formed to have a vertical or outward-spreading shape, whereby flush water is spouted in a horizontal direction from a water spouting port formed on the rear side of this rim portion so as to form a swirl flow, and is spouted toward a discharge trap from a jet spouting port disposed at the bottom and front end of the bowl portion to generate a siphon effect, thereby discharging waste.

SUMMARY OF THE INVENTION

Technical Problem

In a conventional flush toilet such as that shown in the patent document 1, the inner circumference of the rim portion formed on the top edge of the bowl portion is formed in a vertical or outwardly spreading shape, and the entire interior of the bowl can be easily seen from above, thereby imparting superior cleanability to the entire bowl portion when scour-cleaning and the like. On the other hand, when multiple rim spouting ports formed to the rear of the rim portion are disposed, the problem arises that when the interior of the bowl portion is seen from diagonally forward and above by a user, dirt tends to be extremely prominent due to the complexity of the shape, the ease with which it is dirtied, and the difficulty of cleaning, thus reducing the sense of cleanliness perceived by the user and reducing the aesthetic appeal of the bowl portion as a whole.

It is therefore an object of the present invention to provide a flush toilet capable of improving the sense of cleanliness perceived by users and the aesthetic appeal of the bowl portion as a whole.

Solution to Problem

The above object is achieved according to the present invention by providing a flush toilet for discharging waste using flush water supplied from a flush water source, the flush toilet comprising a bowl portion including a bowl-shaped waste receiving surface, a rim portion formed on the top edge portion thereof so that inner circumferential surface thereof rises essentially vertically, and a shelf portion formed between the rim portion and the waste receiving surface; a water discharge path for discharging the waste, the path including an inlet which is connected at the bottom of the bowl portion; a water spouting portion for spouting flush water onto the shelf portion of the bowl portion to form a swirl flow; and a water conduit for supplying the flush water to the spouting portion; wherein the water spouting portion is formed in the front region of the bowl portion, and a part of the inner circumferential surface of the rim portion is formed in an inward-facing overhanging shape; and the water spouting portion is covered by the overhanging part of the rim portion such that a user cannot observe the water spouting portion when viewing from diagonally forward and above the bowl portion.

In the present invention thus constituted, the water spouting portion which spouts flush water onto the shelf portion of the bowl portion and forms a swirl flow is formed in the front region of the bowl portion, and is offset from the easily dirtied rear region of the bowl portion, therefore waste has difficulty adhering to the water spouting portion, and because the water spouting portion is covered by the overhanging part of the rim portion, the user cannot perceive it when looking from diagonally forward and above the bowl portion, so the user's perceived sense of cleanliness and the aesthetic appeal of the bowl portion as a whole are improved.

In the present invention, the water spouting portion is preferably formed in the vicinity of the front end of the rim portion of the bowl portion, and the overhanging part of the rim portion is formed to be left-right symmetrical in the vicinity of the front end of the rim portion of the bowl portion so as to cover the water spouting portion.

In the present invention thus constituted, the water spouting portion is formed in the vicinity of the front end of the rim portion, and the overhanging part of the rim portion covers the water spouting portion, therefore a user cannot see the rim portion, and the user's perception of cleanliness and the aesthetic appeal of the bowl portion as a whole can be improved. Moreover, because the overhanging part of the rim portion is formed to be left-right symmetrical in the vicinity of the rim portion of the bowl portion, the aesthetic appeal of the bowl portion as a whole can be improved.

In the present invention, the water spouting portion is preferably formed on the top end side of the rim portion of the bowl portion.

In the present invention thus constituted, the water spouting portion is formed on the top edge side of the rim portion of the bowl portion, therefore for a user viewing the bowl portion from diagonally forward and above, the water spouting portion falls squarely into the blind angle of the overhanging part of the rim portion, making it more difficult for the user to see the water spouting portion.

The sense of cleanliness perceived by the user can be improved, as can the aesthetic appeal of the bowl portion as a whole.

In the present invention, the rim portion of the bowl portion is preferably formed to be left-right symmetrical in the region visible to the user from diagonally forward and above the bowl portion.

In the present invention thus constituted, the water spouting portion is hidden by the overhanging part of the rim portion, therefore the rim portion can be made left-right symmetrical over the broad region visible by a user from diagonally forward and above the bowl portion. As a result, the present invention enables the aesthetic appeal of the overall bowl portion to be improved.

In the present invention, the majority of the rear region of the rim portion of the bowl portion preferably forms part of a true circle having a predetermined radius.

In the present invention thus constituted, the majority of the rear region of the rim portion of the bowl portion forms part of a true circle having a predetermined radius, therefore when a user views it from diagonally forward and above, the majority of the most prominent rear region of the rim portion of the bowl portion forms part of a true circle of a predetermined radius, therefore the aesthetic appeal of the overall bowl portion can be improved.

In the present invention, the water spouting portion is preferably provided with a water spouting port formed in the vicinity of the front end of the rim portion of the bowl portion; in the vicinity of the front end of the rim portion, the inner surface of the rim portion is formed in an overhanging shape of a vertical surface and a horizontal surface extending inward from the vertical surface; an indented space protruding forward in the vicinity of the front edge of the rim portion is formed on the shelf portion by the vertical surface and horizontal surface, and in the indented space, the water spouting port of the water spouting portion and the vertical surface of the rim portion are continuously formed so as to be flush.

In the present invention thus constituted, the water spouting portion is provided with a water spouting port formed in the vicinity of the front end of the rim portion of the bowl portion; in the vicinity of the front end of the rim portion, an indented space protruding forward is formed on the shelf portion by a vertical surface and a horizontal surface extending inward from the vertical surface; and in the indented space the water spouting port of the water spouting portion and the vertical surface of the rim portion are continuously formed so as to be flush, therefore the water spouting port of the water spouting portion is difficult to see by a user looking from diagonally forward and above the bowl portion, so that the user's perception of cleanliness can be improved. The aesthetic appeal of the bowl portion as a whole is also improved.

Advantageous Effects of the Invention

According to the flush toilet of the present invention, the user's perceived sense of cleanliness can be improved, and the aesthetic appeal of the bowl portion as a whole can be improved.

BRIEF DESCRIPTION OF DRAWINGS

FIG. 17(*b*) shows the results of an analysis of flow rate distribution for jet spout water and the appearance of the flow when a toilet is flushed using a conventional flush toilet, as a comparison example relative to the analytic results shown in FIG. 17(*a*).

DESCRIPTION OF EMBODIMENTS

Referring to the attached drawings, a flush toilet according to an embodiment of the present invention will be described.

Figure 1:
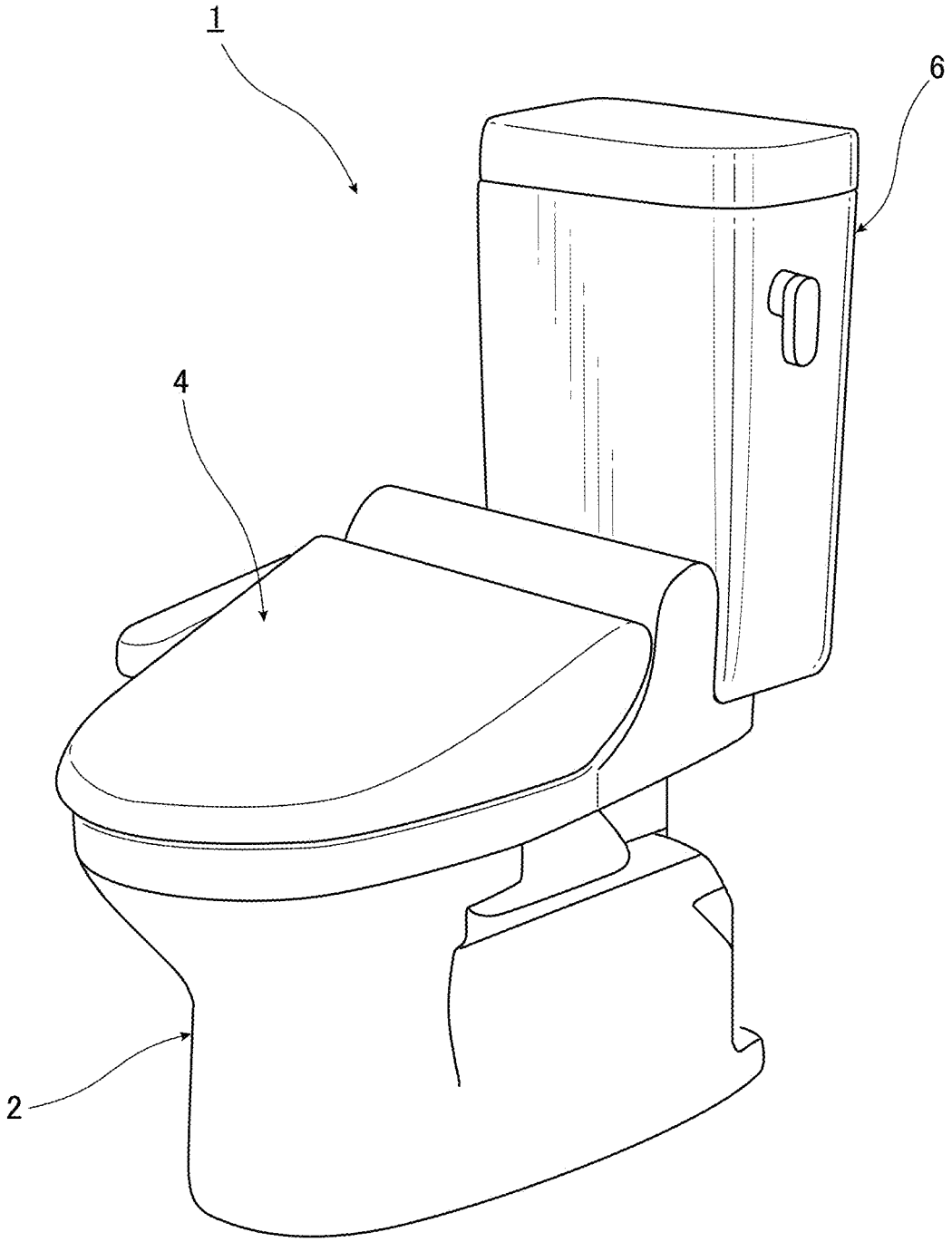
FIG. 1 is a schematic perspective view showing a flush toilet according to an embodiment of the present invention.

FIG. 1 is a schematic perspective view showing the toilet seat on a flush toilet according to an embodiment of the present invention.

As shown in FIG. 1, the flush toilet 1 according to an embodiment of the present invention is what is known as a wash-down type flush toilet in which waste is washed away by the flow action created by water dropping within the bowl portion; it is provided with a ceramic toilet main unit 2, a toilet lid 4 covering a toilet seat (not shown) disposed on the upper surface of the toilet main unit 2, and a gravity feed reservoir tank 6 serving as flush water source, for storing flush water used in toilet flushing and for supplying water to the toilet main unit 2.

Note that with respect to the flush water source supplying flush water to the toilet main unit 2, there is no limitation to a tank-type apparatus such as the gravity fed reservoir tank 6 shown in this embodiment; flush water may also be supplied by a water main direct pressure system directly utilizing water main supply pressure, or by a flush valve, or by pump assisted pressure, etc.

Figure 2:
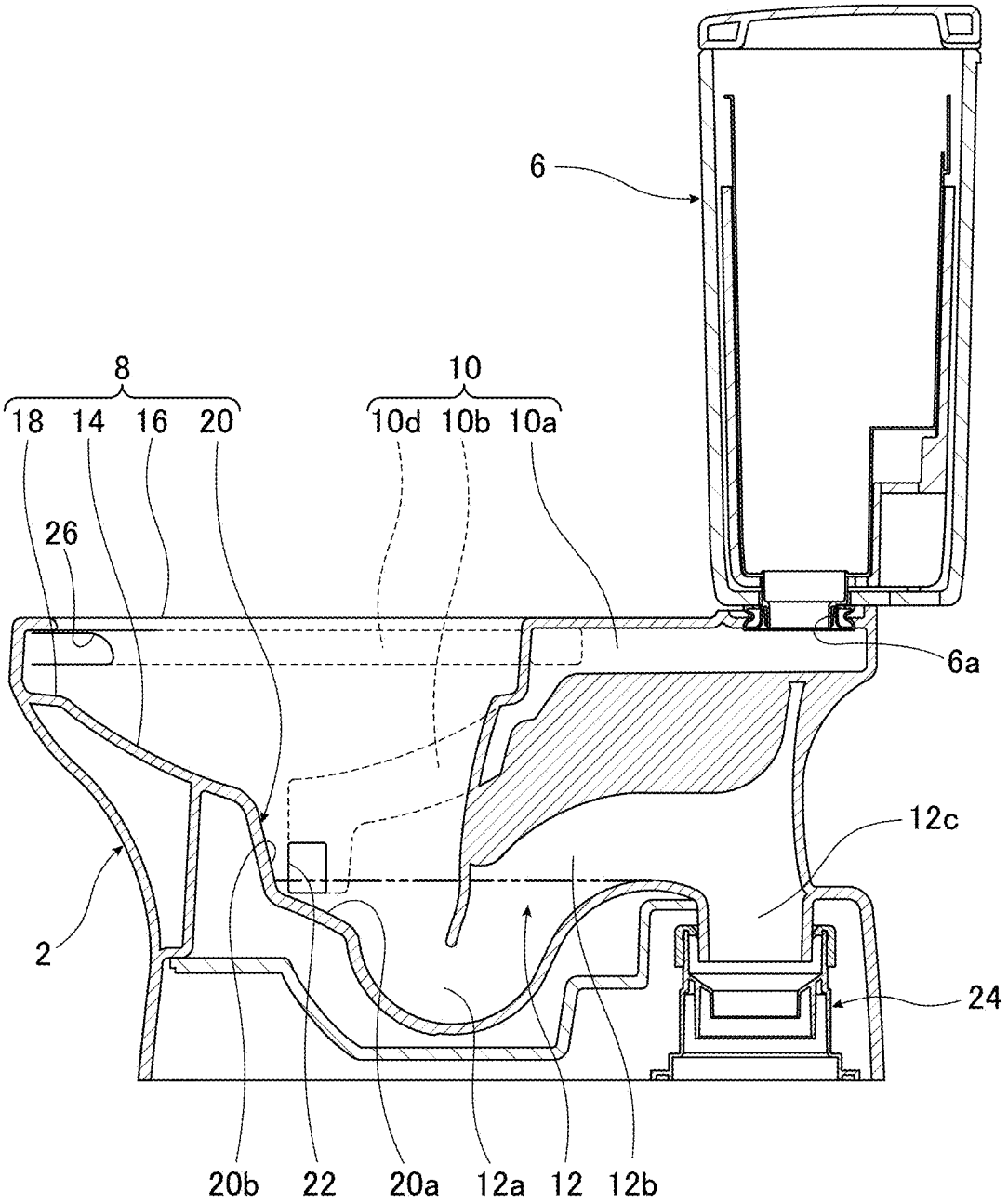
FIG. 2 is a side view in which the toilet seat and toilet cover are omitted in a flush toilet according to an embodiment of the present invention.
Figure 3:
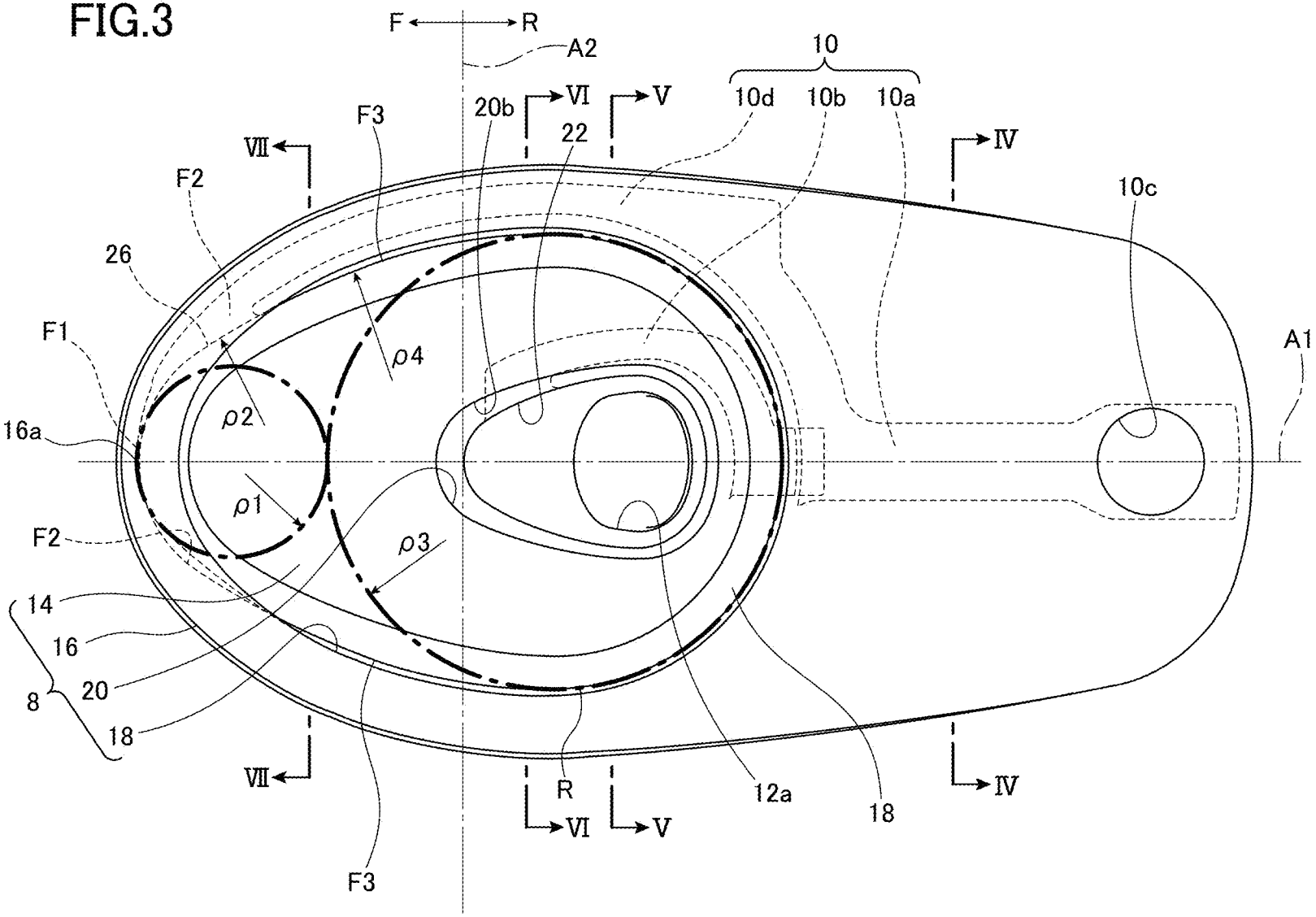
FIG. 3 is a plan view showing the main toilet unit of a flush toilet according to an embodiment of the present invention.
Figure 4:
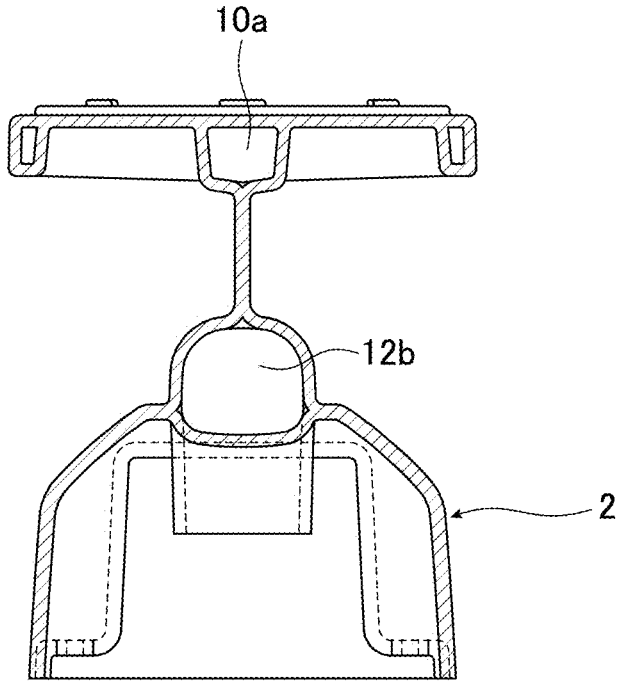
FIG. 4 is a cross sectional view seen along line IV-IV in FIG. 3.
Figure 5:
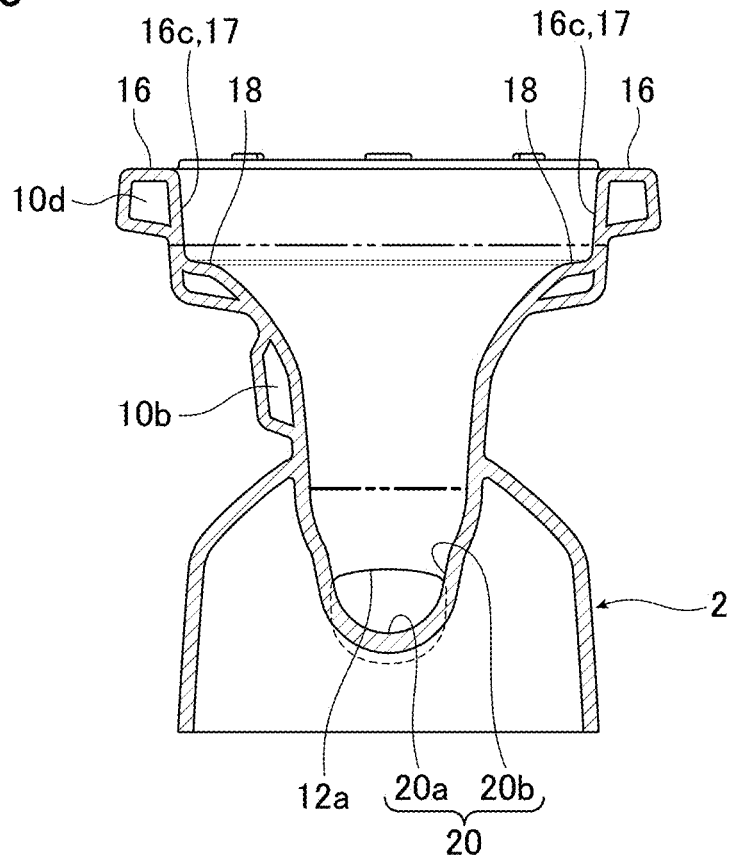
FIG. 5 is a cross sectional view seen along line V-V in FIG. 3.

FIG. 2 is a side view in which the toilet seat and toilet cover are omitted from a flush toilet according to an embodiment of the present invention; FIG. 3 is a plan view showing a flush toilet according to an embodiment of the present invention.

As shown in FIGS. 2 and 3, a bowl portion 8 is formed at the front top portion of the toilet main unit 2. Also, a water conduit 10 for spouting flush water supplied from the reservoir tank 6 to the bowl portion 8 is formed at the rear top portion of the toilet main unit 2.

In addition, a water discharge trap pipe 12 serving as a discharge path for discharging waste inside the bowl portion 8 is formed at the bottom of the bowl portion 8.

The bowl portion 8 is provided with a bowl-shaped waste receiving surface 14, a rim portion 16 formed along the top edge portion of the bowl portion 8, and a shelf portion 18 formed between this waste receiving surface 14 and the rim portion 16.

The bowl portion 8 is provided with a concave portion 20 formed in a region below the waste receiving surface 14 and connected to the water discharge trap pipe 12; this concave portion 20 is provided with a bottom surface 20*a* and a wall surface 20*b* connecting the bottom surface 20*a* and the bottom edge portion 14*a* of the waste receiving surface 14.

In addition, seen from the front side of the toilet main unit 2 with respect to center line A1 (see FIG. 3) which equally divides the bowl portion 8 in the left-right direction, a jet water spouting port 22 is formed on the side wall surface 20*b* at the left side of the concave portion 20; this jet water spouting port 22 is connected from the shared water conduit 10*a* on the water conduit 10, described in detail below, to the branched jet water conduit 10*b*, and the main flow of the flush water spouted from the jet water spouting port 22 circulates within the concave portion 20. Thus when flush water is spouted from the jet water spouting port 22 it becomes difficult for accumulated water in the concave portion 20 of the bowl portion 8 to spread outward by the swirling flow f4 of the jet water spout, and floating waste can be gathered at approximately the center of the water accumulated in the concave portion 20 and reliably discharged. In addition, water splash-ups produced by the swirling, downward flow, and collision of rim spout water spouted from the rim spouting port 26 described below can be more effectively suppressed when flush water seeks to splash out of the bowl portion 8 concave portion 20.

An inlet port 12*a* on the above-described water discharge trap pipe 12 opens at the back and rear of the concave portion 20 of the waste receiving surface 14 of the bowl portion 8; a rise path 12*b* extends rearward from this inlet port 12*a*. A fall path 12*c* connects to this rise path 12*b*; the bottom end of this fall path 12*c* is connected to an underfloor discharge pipe (not shown) via a discharge socket 24.

Note that in the flush toilet 1 of the present embodiment, one example of a floor discharge-type flush toilet in which the bottom end of the fall path 12*c* on a water discharge trap pipe 12 is connected to an underfloor discharge pipe (not shown) is described, but the flush toilet is not limited to this form, and may also be applied to an above-floor discharge-type flush toilet in which the end of the fall path 12*c* is disposed on the rear wall side of the flush toilet and is connected to an above-floor discharge pipe.

Next, referring to FIGS. 2 through 8, details of the water conduit 10 on flush toilet 1 are described.

Figure 8:
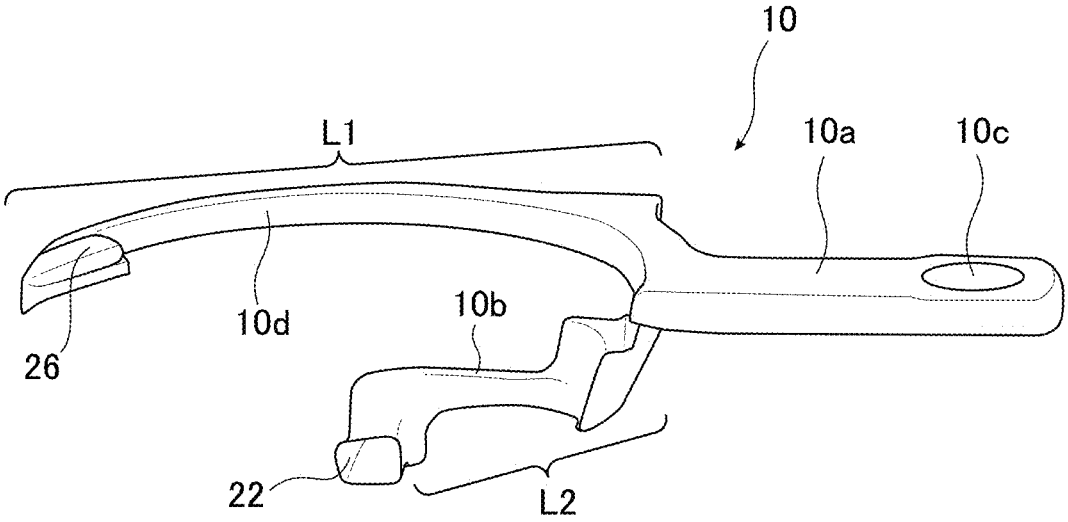
FIG. 8 is a perspective view showing the water conduit in a flush toilet according to an embodiment of the present invention.

FIGS. 4 through 7 are respectively cross sectional views seen along lines IV-IV, V-V, VI-VI, and VII-VII in FIG. 3; FIG. 8 is a perspective view showing the overall water conduit in a flush toilet according to an embodiment of the present invention.

As shown in FIGS. 2 through 8, the water conduit 10 is provided with: a shared water conduit 10*a* extending from the inlet portion 10*c* connected to the discharge port 6*a* on the reservoir tank 6 to the vicinity of the back surface side of the bowl portion 8, and a jet water conduit 10*b* and rim water conduit 10*d* respectively branching from the water conduit 10*a* in the vicinity of the back surface side of the bowl portion 8.

The rim water conduit 10*d* branches from the shared water conduit 10*a* in the vicinity of the back surface of the bowl portion 8, extending toward the front along the interior of the rim portion 16 positioned on the left side as seen from the front side of the toilet main unit 2 relative to the center line A1 (see FIG. 3) which equally divides the bowl portion 8 in the left-right direction, and extends up to a single rim spouting port 26 (described in detail below) disposed on the left side as seen from the front side of the toilet main unit 2 within the front region F of the rim portion 16.

The jet water conduit 10*b* branches from the shared water conduit 10*a* in the vicinity of the back side of the bowl portion 8, extending forward so as to circumvent the outside of the left side wall surface 20*b* of the concave portion 20 of the bowl portion 8 seen from the front side of the toilet main unit 2 relative to the center line A1 (see FIG. 3) which equally divides the bowl portion 8 in the left-right direction, then extending up to the jet water spouting port 22 formed on the left side wall surface 20*b* of the concave portion 20. When the bowl portion 8 is respectively equally divided in the front-back and left-right directions, the jet water spouting port 22 is disposed on the rear side relative to the rim spouting port 26 on the rim portion 16, and on the left side when seen from the front of the bowl portion 8.

Note that it is sufficient for the rim spouting port 26 and the jet water spouting port 22 to be formed on the same side on either the left or the right of the bowl portion 8.

By forming the rim spouting port 26 on the front side of the jet water spouting port 22, even if splashing outside of the concave portion 20 of the bowl portion 8 by the swirl flow (referred to below as "diagonal swirl flow f4") of flush water spouted from the jet water spouting port 22 occurs, it can be restrained by the force of the swirl flow (referred to below as "swirl flow f5") spouted from the rim spouting port 26.

Furthermore, the route length L1 of the rim water conduit 10*d* is set to be longer than the route length L2 of the jet water conduit 10*b* as a means of setting the timing of water spouting so that jet spouting of flush water conducted to the jet water spouting port 22 through the jet water conduit 10*b* from the shared water conduit 10*a* begins prior to commencing rim spouting of flush water conducted to the rim spouting port 26 through the rim water conduit 10*d* from the shared water conduit 10*a*. This form of setting permits air present in the shared water conduit 10*a* at the time of flush start to be evacuated from the jet water spouting port 22 via the jet water conduit 10*b*, so that air discharged from the rim spouting port 26 when water spouting at the rim spouting port 26 begins can be reduced using a simple structure. The popping sound and splash-up produced when air, having flowed from the shared water conduit 10*a* into the rim water conduit 10*d* together with flush water, is compressed within the rim water conduit 10*d* and discharged from the rim spouting port 26 can be prevented, as can the splashing of water to outside the toilet 1.

Also, even if water splash-up occurs when air compressed within the jet water conduit 10*b* is discharged together with flush water at the jet water spouting port 22, the jet water spouting port 22 is positioned at the bottom in the bowl portion 8—i.e. on the side wall surface 20*b* of the concave portion 20 between the waste receiving surface 14 and the water discharge trap pipe 12, therefore water splashing outside of the toilet 1 can be prevented.

Furthermore, even if the air present within the shared water conduit 10*a* when flushing begins mixes in with flush water flowing from the shared water conduit 10*a* to the rim water conduit 10*d*, a rim spouting port 26 is formed on the front region F of the bowl portion 8, so that the rim water conduit 10*d* forms a comparatively long path from the shared water conduit 10*a* in the vicinity of the back surface of the bowl portion 8 to the rim spouting port 26, and air becomes sufficiently diffused as it flows through the rim water conduit 10*d* that the popping sound and water splash-up produced when water is spouted from the rim spouting port 26 can be suppressed.

Note that in the present embodiment, it is explained as an example of a means for starting jet water spouting before the start of rim water spouting a form whereby the route length L1 of the rim water conduit 10*d* is set to be longer than the route length L2 of the jet water conduit 10*b*, but the present invention is not limited to this form, and it is also acceptable to set the respective flow rates and volumes within the rim water conduit and the jet water conduit so that jet water spouting is started before the start of rim water spouting.

It is also acceptable to provide a pipe member communicating with the shared water conduit 10*a* and the interior of the concave portion 20 in place of the jet water conduit 10*b* as a way of evacuating air inside the shared water conduit 10*a*.

Next, referring to FIG. 3, FIGS. 5 through 7, and FIGS. 9 through 11, details of a rim portion 16, a shelf portion 18 and a rim spouting port 26 of the bowl portion 8 of the flush toilet 1 are described.

Figure 9:
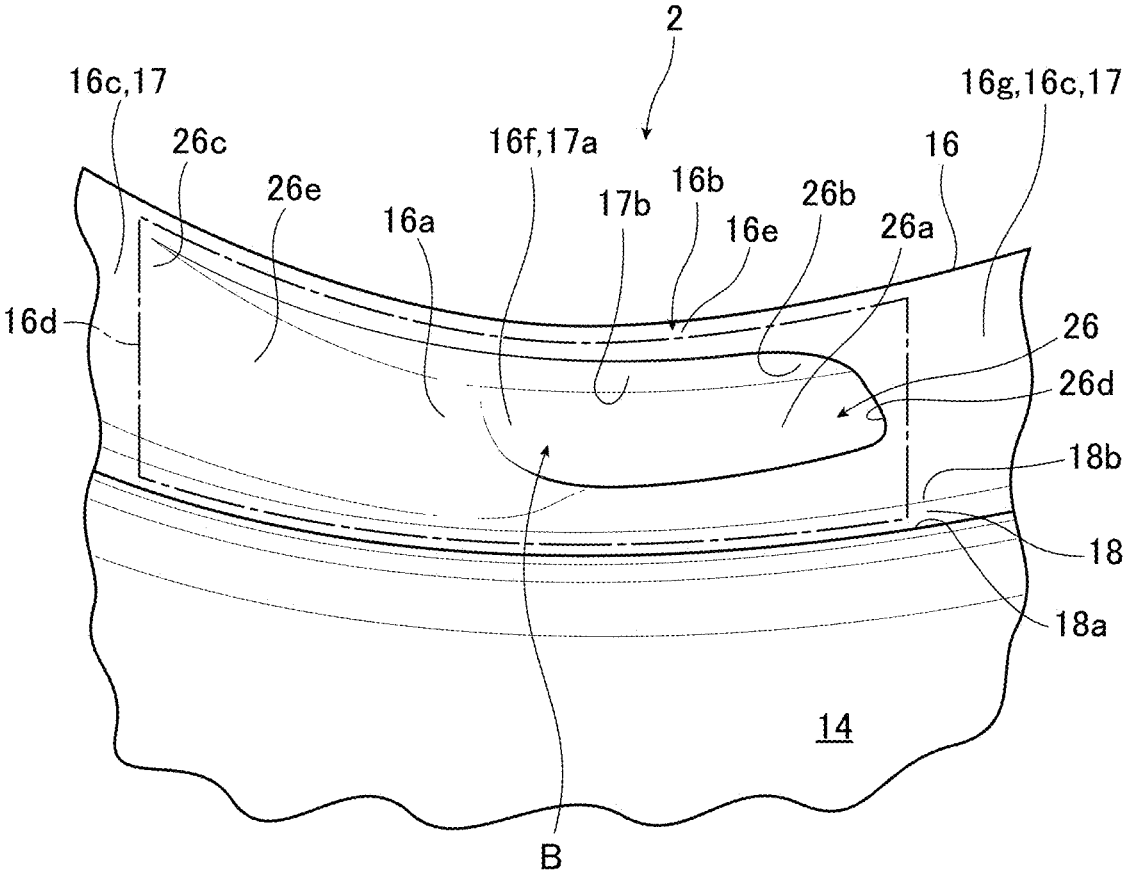
FIG. 9 is an enlarged perspective view in which the rim water spouting port in the front region within the bowl portion of a flush toilet according to an embodiment of the present invention is viewed diagonally from below looking from the rear side.
Figure 10:
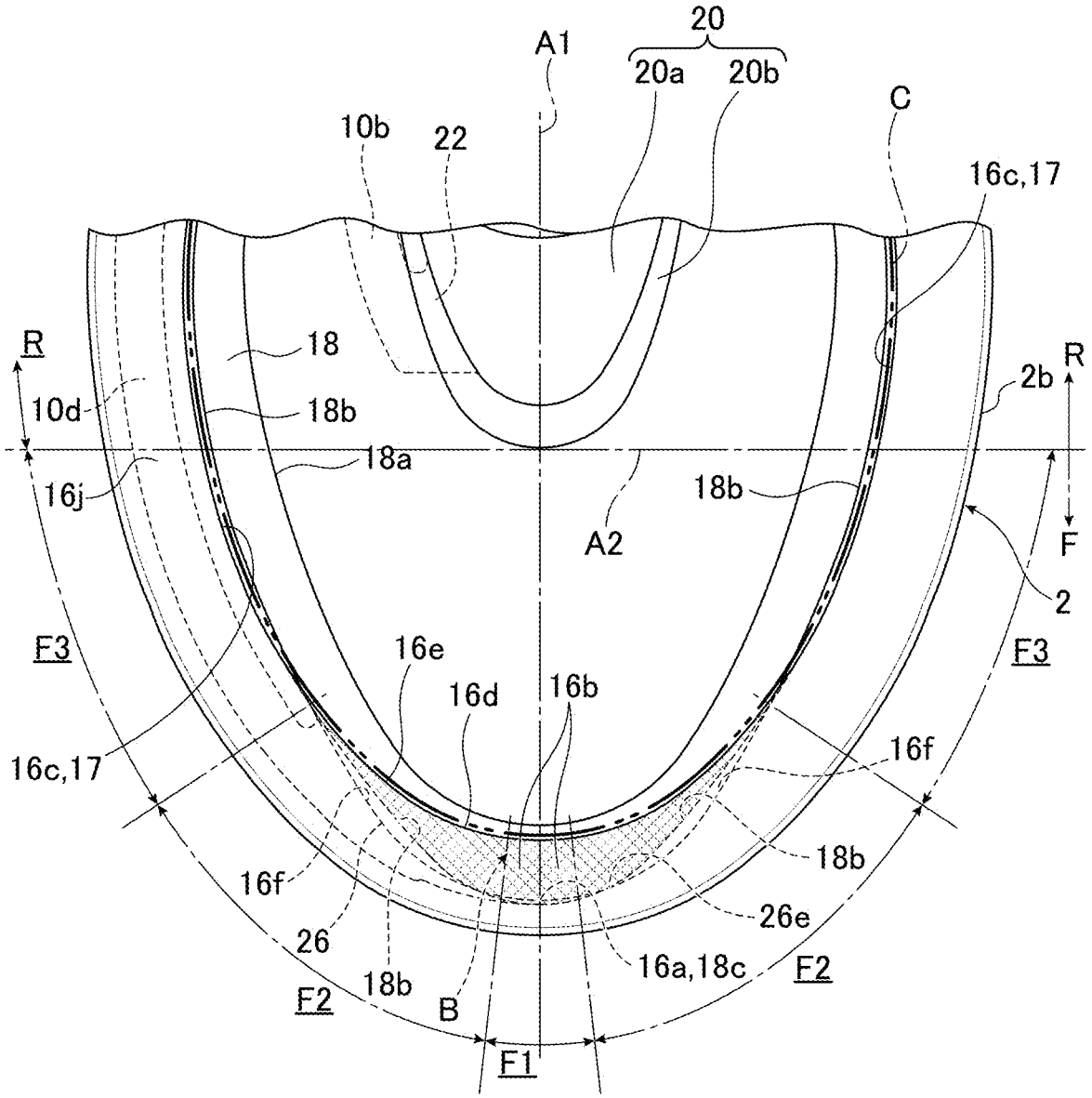
FIG. 10 is a partial enlarged plan view in which the front part of a flush toilet according to the embodiment of the present invention shown in FIG. 3 is enlarged.
Figure 11:
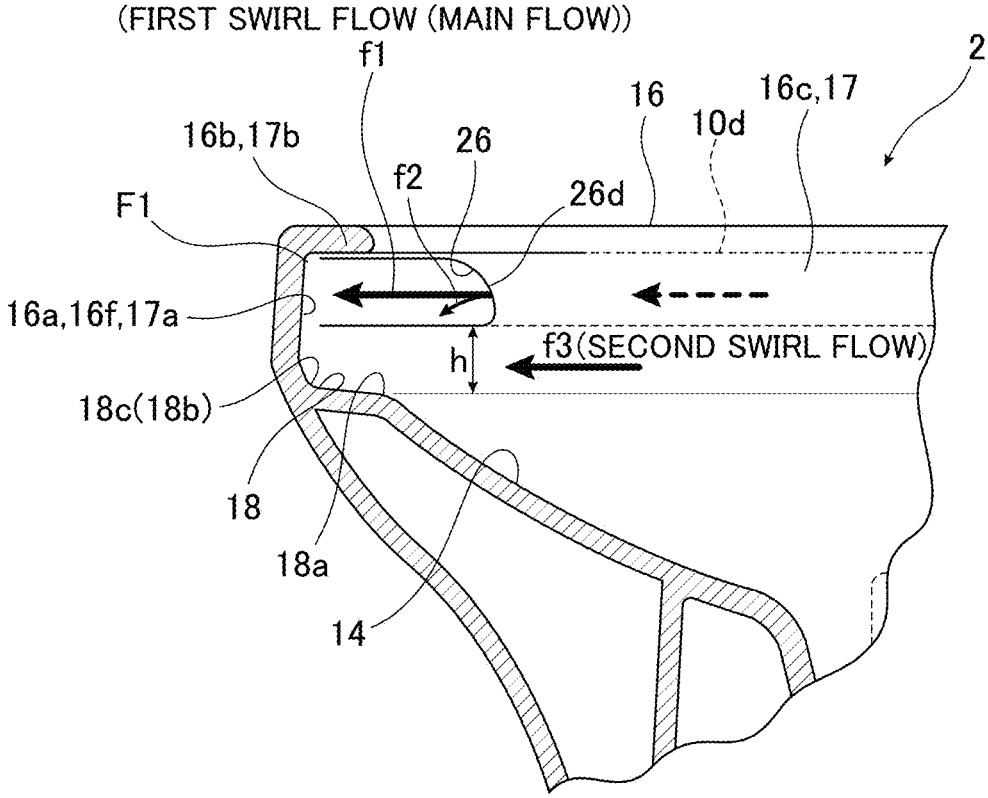
FIG. 11 is a partial enlarged plan view in which the rim water spouting portion of a flush toilet according to the embodiment of the present invention shown in FIG. 3 is enlarged.

FIG. 9 is an enlarged perspective view of the rim spouting port in the front region within the bowl portion of a flush toilet according to an embodiment of the present invention as seen from the diagonally below on the rear side; FIG. 10 is a partial enlarged plan view zoomed in on the front part of the flush toilet according to the embodiment of the present invention shown in FIG. 3; FIG. 11 is a partial enlarged perspective view zoomed in on the rim spouting port part of a flush toilet according to the embodiment of the present invention shown in FIG. 2.

As shown in FIGS. 3 and 10, the bowl portion 8 is provided with a front region F and a rear region R, which are equal divisions of the bowl portion 8 created by the center line A2 (see FIG. 3) extending in the left-right direction of the bowl portion 8.

The front region F of the bowl portion 8 is provided with a region F1 which is disposed symmetrically relative to the center line A1 and the front end portion 16*a* (the inner circumferential front end portion 16*a*) of the inner circumferential surface 17 of the rim portion 16, and includes the front end portion 16*a*, a region F2 positioned behind the region F1, and a region F3 positioned yet further behind this region F2.

The front end portion 16*a* within the front region F1 of the rim portion 16 has the smallest curvature radius ρ1 within the entire perimeter of the rim portion 16; the rim spouting port 26 is formed within the front region F2 positioned behind the front end portion 16*a* within the front region F1 of the rim portion 16, and flush water is spouted toward this front end portion 16*a*.

In other words, the rim spouting port 26 is disposed in the vicinity of the minimum curvature radius portion positioned at the front end portion 16*a* of the rim portion 16, and by spouting flush water toward this minimum curvature radius portion, the water spouting direction vector and the water flow force of the flush water spouted from the rim spouting port 26 can be stabilized so that after passing through the front end portion 16*a* of the rim portion 16 while maintaining a comparatively high water flow force, flush water can swirl to the rear region R of the rim portion 16. By so doing, the easily dirtied rear region R of the bowl portion 8 can be properly washed, and since the flush water continues to swirl with its flow force maintained after passing through the rear region R, a situation is prevented whereby cleaning is poor due to an inability to also swirl in the vicinity of the rim portion 16 front end portion 16*a*.

Flush water spouted from the rim spouting port 26 makes a first circulation swirl along the rim portion 16 after passing the smallest curvature radius portion of the front end portion 16*a* of the rim portion 16, but the flow of flush water flowing down from the rim spouting port 26 to the shelf portion 18 is suppressed by the effect of centrifugal force acting on the outer side of the rim portion 16 when passing the smallest curvature radius portion of this rim portion 16, therefore a collision with the swirling flow on the shelf portion 18 can be restrained when the first circulation swirl has ended and the second circulation swirl is seeking to begin.

In addition, the rim spouting port 26 is adjacent on the left side as seen from the front side of the toilet main unit 2 relative to the front end portion 16*a* within the front region F1 of the bowl portion 8 rim portion 16, and is formed within the front region F2, which is the part in which the curvature radius ρ2 changes from a large curvature radius to a small curvature radius from the rear toward the front. Flush water spouted from the rim spouting port 26 thus immediately reaches the front end portion 16*a* on the rim portion 16 with a strong flow force maintained, and can thereafter swirl to the rear region R of the rim portion 16, thus preventing a situation in which cleaning is poor due to an inability to swirl in the vicinity of the smallest curvature radius front end portion 16*a* of the rim portion 16. Moreover, a moderate energy loss arising when flush water spouted from the rim spouting port 26 at a strong flow force toward the front end portion 16*a* in the front region F1 of the rim portion 16 passes over the front end within the front region F1 of the rim portion 16 formed at the minimum curvature radius ρ1 results in moderate restraint of flow force so that splashing of flush water outside the toilet due to over-strong flow force can be prevented.

Also, the majority of the rear region R of the rim portion 16 of the bowl portion 8 forms a portion (an arc shape) of a true circle having a fixed radius (curvature radius ρ3). Therefore since the curvature radius ρ3 (the radius of the circle) does not change in the majority of the rear region R of the rim portion 16 of the bowl portion 8, loss of energy in the flush water when passing over rear region R of the rim portion 16 can be restrained, and flush water can be made to more reliably swirl, such that swirling occurs with a comparatively strong flow force maintained up to the rim portion 16 rear region R, and the rear region R of the bowl portion 8, which is easily-dirtied, can be reliably cleaned. Also, since the majority of the rear region R of the rim portion 16 of the bowl portion 8 forms a portion of a true circle of a predetermined radius (curvature radius ρ3), the majority of the rear region R of the rim portion 16 of the bowl portion 8 which is most prominent when seen by a user from diagonally forward and above forms a portion of a true circle with a predetermined radius (curvature radius ρ3), thereby improving the aesthetic appeal of the entire bowl portion 8.

Within the front region F, the rim portion 16 of the bowl portion 8 is provided with a front region F3 formed at a curvature radius ρ4, equal to the curvature radius ρ2 and larger than the curvature radius ρ3 (ρ4=ρ2>ρ3); this front region F3 is disposed to be closely proximate to the vicinity of the front end portion 16*a* within the front region F1 between the front region F2 and the rear region R. Thus flush water which has passed from the rim spouting port 26 through the front end portion 16*a* of the rim portion 16 passes through the front region F2 proximate to the vicinity of the front end portion 16*a* in the front region F1 of the bowl portion 8 rim portion 16 and maintains a comparatively strong flow force as it flows into the front region F3. By flowing through the front region F3 of the rim portion 16 formed with a curvature radius ρ4, which is larger than the curvature radius ρ3 of the rear region R of the rim portion 16, this flush water is able to flow smoothly to the rear region R of the rim portion 16, maintaining in a stable state the flow force of the flush water from front regions F1 and F2, which is comparatively stronger than that of the front region F3, so that even if the inner circumferential surface 17 of the rim portion 16 has a shape rising essentially vertically, splashing to the outside of the flush toilet 1 by flush water flowing in the rim portion 16 can be prevented.

Note that in this embodiment, it is explained the form in which the curvature radius ρ1 in the front region F1 of the rim portion 16 is set to be smaller than the curvature radius ρ3 of the rear region R of the rim portion 16, but the flush toilet is not limited to this form, and it is also acceptable to set the curvature radius ρ1 of the front region F1 of the rim portion 16 to be equal to the curvature radius ρ3 of the rear region R of the rim portion 16. Alternatively, it is also acceptable to set any one of the curvature radii ρ1, ρ2, or ρ4 of the front regions F1, F2, and F3 of the rim portion 16 to be equal to the curvature radius ρ3 of the rear region R of the rim portion 16.

The bowl portion 8 rim portion 16 is provided with an overhanging part 16*b*, formed in a shape such that the top edge portion from the rim spouting port 26 in the front region F2 facing toward the front side up to the vicinity of the front end portion 16*a* within the front region F1 of the rim portion 16 protrudes locally inward, and the top of the rim spouting port 26 is covered by this overhanging part 16*b*.

The rim portion 16 of the bowl portion 8 is provided with a rising portion 16*c* shaped to rise in an appropriate vertical direction in the region of the inner circumferential surface 17 outside the overhanging part 16*b*.

Thus an inward-facing overhang shape is formed by the overhanging part 16*b* in the front regions F1 and F2 around the front end portion 16*a* of the inner circumferential surface 17 of the rim portion 16, and in the front region F3 and rear region R outside the vicinity of the rim portion 16 front end portion 16*a*, is formed into an approximately vertical rising shape, so that in the vicinity of the smallest curvature radius ρ1 front end portion 16*a* of the rim portion 16, there is no splashing of water outside the flush toilet 1, and the flow force of flush water spouted from the rim spouting port 26 can be increased. Also, since flush water can swirl up to the rear region R of the rim portion 16 while sufficiently maintaining a comparatively strong flow force, the easily dirtied rear region of the bowl portion 8 can also be more reliably cleaned.

Also, because of the overhanging part 16*b* in the front regions F1 and F2 in the vicinity of the front end portion 16*a* of the rim portion 16, even if splash-up occurs near the rim spouting port 26 of the rim portion 16 where it is particularly prone to occur, that splash-up hits the top edge portion of the overhanging part 16*b* on the rim portion 16, therefore splashing outside the toilet 1 can be prevented.

In addition, since the inner circumferential surface 17 of the bowl portion 8 rim portion 16 is formed to rise approximately vertically in the region of the front end, any waste which may adhere there can be easily removed, and sanitation improved.

Note that in the flush toilet 1 of the present embodiment, it is explained as an example a form in which the inner circumferential surface 17 of the rim portion 16 is provided with a rising portion 16*c*, but as an alternative to this rising portion 16*c*, this could also be set to an overhang shape over essentially the entire perimeter of the inner circumferential surface of the rim portion, or could be what is known as the open rim type, in which the inside of a rim water conduit formed along the circumferential direction of the rim portion 16 is left open.

The rim spouting port 26 is positioned by a predetermined distance h above the height position of the shelf portion 18 of the bowl portion 8, and is formed at the top end side of the rim portion 16 of the bowl portion 8. Thus flush water spouted from the rim spouting port 26 forms a flow (swirl flow f1) which passes the vicinity of the front end portion 16*a* of the rim portion 16 where the curvature radius is small and swirls to the rear side of the rim portion 16, forming a falling flow (falling flow f2) from the top end side of the rim portion 16; the interior of the bowl portion 8 can thus be effectively cleaned by this swirl flow f1 and falling flow f2. The flush water spouted from the rim spouting port 26, which is in a comparatively high position disposed at the top end side of the rim portion 16, enables reliable cleaning around the front end portion 16*a* of the rim portion 16 of the bowl portion 8.

Moreover, by forming the rim spouting port 26 on the rim portion 16 at a predetermined distance h above the shelf portion 18, flush water spouted from the rim spouting port 26 swirls, as will be described in detail below using FIGS. 14 and 15, without the swirl flow f1 of the first circulation first swirl trajectory T1 flowing down on the shelf portion 18; the second circulation second swirl trajectory T2 swirl flow f3 swirls on the shelf portion 18, and in the vicinity of the rim spouting port 26 where splashing is particularly prone to occur, splash-up caused by the collision between flush water swirling around the rim portion 16 in the first circulation first swirl trajectory T1 and the second circulation second swirl trajectory T2 can be suppressed.

In addition, because the rim spouting port 26 is formed at the top end side of the rim portion 16 of the bowl portion 8, the rim spouting port 26 reliably falls into the blind angle of the overhanging part 16*b* of the rim portion 16 from the standpoint of a user looking at the bowl portion 8 from diagonally forward and above, making it more difficult for the user to see the rim spouting port 26. Furthermore, in addition to improving the sense of cleanliness perceived by the user, the overall aesthetic appeal of the bowl portion 8 can also be improved.

Moreover, the rim spouting port 26 is formed on the rim portion 16, which is positioned further outside (on the outside portion 18*b* side of the shelf portion 18) than the inner edge portion 18*a* of the shelf portion 18 of the bowl portion 8, and as will be described in detail below using FIGS. 14 and 15, in plan view the first swirl trajectory T1 is positioned outside of the second swirl trajectory T2. Thus in the vicinity of the rim spouting port 26 where splashing is particularly prone to occur, splash-up caused by collision between the flush water in the first swirl trajectory T1 and the second swirl trajectory T2 can be effectively suppressed.

Also, the rim portion 16 on the bowl portion 8 is provided with a continuously formed portion 26*c*, continuously formed from a top edge portion 26*b* forming the top surface of a water passageway 26*a* formed within the rim spouting port 26, facing downstream to the rising portion 16*c* on the inner circumferential surface 17 of the rim portion 16; this continuously formed portion 26*c* is positioned on the inner circumferential surface 17 of the rim portion 16 to the right of the center line A1 (see FIG. 3) as seen from the front side of the toilet main unit 2. The rim portion 16 overhanging part 16*b* is continuously formed on the top surface of the rim spouting port 26 by such a continuously formed portion 26*c*, therefore flush water spouted from the rim spouting port 26 flows smoothly along the inner circumferential surface 17 of the rim portion 16. Because of the formation of the swirl flow f1 and falling flow f2, which pass near the front end portion 16*a* of the small curvature radius rim portion 16, the vicinity of the front end portion 16*a* of the rim portion 16 of the bowl portion 8 can be reliably cleaned. In addition, the continuous formation of the top edge portion 26*b* forming the top surface of the water passageway 26*a* forming rim spouting port 26, and of the inner circumferential surface 17 of the rim portion 16, enables flush water spouted from the rim spouting port 26 to flow smoothly along the inner circumferential surface 17 of the rim portion 16 by centrifugal force, so that splash-ups produced by the collision of separate swirling flush waters can be suppressed.

The overhanging part 16*b* in the front regions F1 and F2 of the rim portion 16 extend from the rim spouting port 26 toward the front side to the front end portion 16*a* within the front region F1 of the rim portion 16, and from this front end portion 16*a* to the continuously formed portion 26*c*; seen from above, the bowl portion 8 is symmetrically left-right disposed relative to the front end portion 16*a* of the rim portion 16. The rim spouting port 26 is thus formed in the vicinity of the front end portion 16*a* of the rim portion 16, and the overhanging part 16*b* of the rim portion 16 covers the rim spouting port 26, so that viewed by user from diagonally forward and above, the rim spouting port 26 cannot be observed. Furthermore, the overhanging part 16*b* of the rim portion 16 is formed to be left-right symmetrical in the vicinity of the front end portion 16*a* of the rim portion 16 of the bowl portion 8, thus enabling the overall aesthetic appeal of the bowl portion 8 to be improved.

Also, facing in the direction of spouting from the rim spouting port 26*a*, the perimeter portion 26*d* on the rear side of the rim spouting port 26 is tilted from bottom to top. Flush water spouted from the rim spouting port 26 by means of the perimeter portion 26*d* of the rim spouting port 26 tilted from bottom to top thus forms a flow (swirl flow f1) passing the vicinity of the front end portion 16*a* of the small curvature radius rim portion 16 and swirling toward the rear side of the rim portion 16, and forms a falling flow (falling flow f2) from the top end side of the rim portion 16; the front end portion 16*a* of the rim portion 16 of the bowl portion 8 can thus be effectively cleaned by this swirl flow f1 and falling flow f2.

The incline from bottom to the top of the rim spouting port 26 perimeter portion 26*d* in the direction of water spouting thus enables flush water spouted from the rim spouting port 26 to flow downward even if an uncleaned portion is created at the boundary between the first swirl trajectory T1 and the second swirl trajectory T2, thereby preventing the occurrence of such uncleaned portions.

Additionally, part of the flush water spouted from the rim spouting port 26 can be made to drop by the rim spouting port 26 perimeter portion 26*d* inclined from the bottom to the top in this water spouting direction, and this falling flush water allows more effective suppression of the tendency for splashing to the outside by the swirl flow f4 spouted from the jet water spouting port 22. In the concave portion 20 of the bowl portion 8, the addition of rim spout water falling in this way to water spouted from the jet water spouting port 22 results in the creation of a swirl flow f4 provided with a strong rotational force in which the horizontal swirl flow and the vertical swirl flow are combined, thereby raising waste discharge performance. Moreover, splash-ups arising when rim spout water and jet spout water collide can also be more effectively suppressed.

The bowl portion 8 rim portion 16 is formed to be left-right symmetrical in the rear region R and front region F3, etc. within the bowl portion 8 visible to the user when the bowl portion 8 is viewed diagonally from forward and above; the inside circumference of the rim spouting port 26 is open but the top is covered by the overhanging part 16*b*, so is not visible to a user looking at the rim portion 16 diagonally from forward and above the bowl portion 8, and the overall aesthetic appeal of the bowl portion 8 can thus be improved.

In particular, as shown in FIGS. 9 through 11, the rim spouting port 26 is formed in the vicinity of the front end portion 16*a* of the rim portion 16 of the bowl portion 8, and the inner circumferential surface 17 in the front region F1 of the rim portion 16 is formed into an overhang shape in the vicinity of the front end portion 16*a* of the rim portion 16 by a vertical surface 17*a* and a horizontal surface 17*b* extending inward from this vertical surface 17*a*. A forward protruding concave space B is formed on the shelf portion 18 in the vicinity of the front end portion 16*a* of the rim portion 16 by this vertical surface 17*a* and horizontal surface 17*b*, and within this concave space B the rim spouting port 26 and the vertical surface 17*a* of the rim portion 16 are continuous so as to be flush.

I.e., in the bowl portion 8 rim portion 16 front regions F1 and F2, the rim spouting port 26 is formed within an indented space B, formed so as to protrude forward of and by a predetermined width to the left and right relative to a virtual surface 16*d*, which is flush with the inner circumferential surface 17 forming the rising portion 16*c* rising essentially vertically in the rear region R and front region F3 of the rim portion 16 of the bowl portion 8. The top edge portion of this concave space B matches the overhanging part 16*b*, and the bottom end of the front end portion 16*a* of the inner circumference surface 16*f* in the concave space B matches the front end 18*c* of the outside portion 18*b* of the shelf portion 18.

The rim spouting port 26 is positioned forward of the rear edge 16*e* of the top edge portion 16*b* of indented space B and behind the front end 18*c* of the outside edge portion 18*b* of the shelf portion 18; a water passageway 26*a* extending from the rear end of the rim spouting port 26 perimeter portion 26*d* along the inner circumference surface 16*f* within the indented space B up to the vicinity of the front end portion 16*a* is formed within the indented space B, and the extended part 26*e* extending from this water passageway 26*a* through the front most portion 16*a* of the inner circumference surface 16*f* within the indented space B is continuously formed from within the indented space B to the continuously formed portion 26*c* of the rim portion inner circumferential surface 16*c*. It is thus difficult for users viewing the bowl portion 8 diagonally from forward and above to see the rim spouting port 26, and the sense of cleanliness perceived by the user can thus be improved.

Furthermore, although discussed in detail below using FIGS. 14 and 15, the direction in which flush water spouted from the rim spouting port 26 swirls and the direction in which flush water spouted from the jet water spouting port 22 swirls are the same direction when seen in plan view. The water spouting direction D1 in the jet water spouting port 22 (arrow D1 in FIG. 14) is diagonally downward facing the front, and is essentially the same as the water spouting direction D2 in the rim spouting port 26 (arrow D2 in FIG. 14).

Next, referring to FIGS. 6, 10, 12, and 13, an adhesive step when manufacturing a ceramic flush toilet 1 according to an embodiment of the present invention is described.

Figure 12:
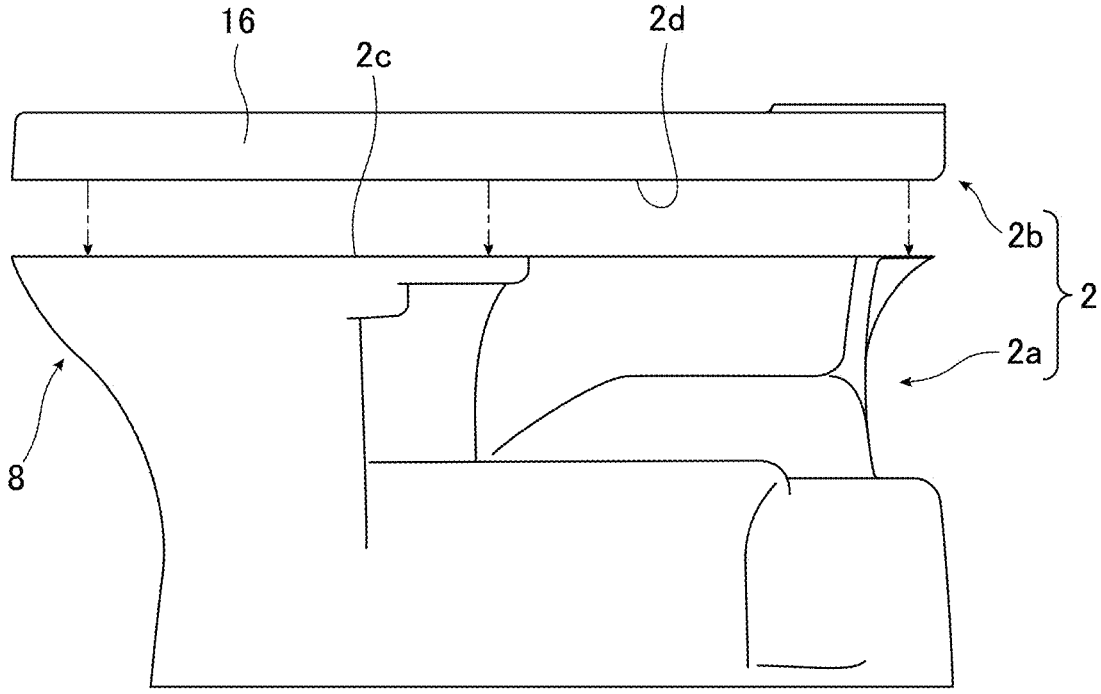
FIG. 12 is a side view showing the flush toilet main body prior to an adhesion step in a flush toilet according to an embodiment of the present invention.
Figure 13:
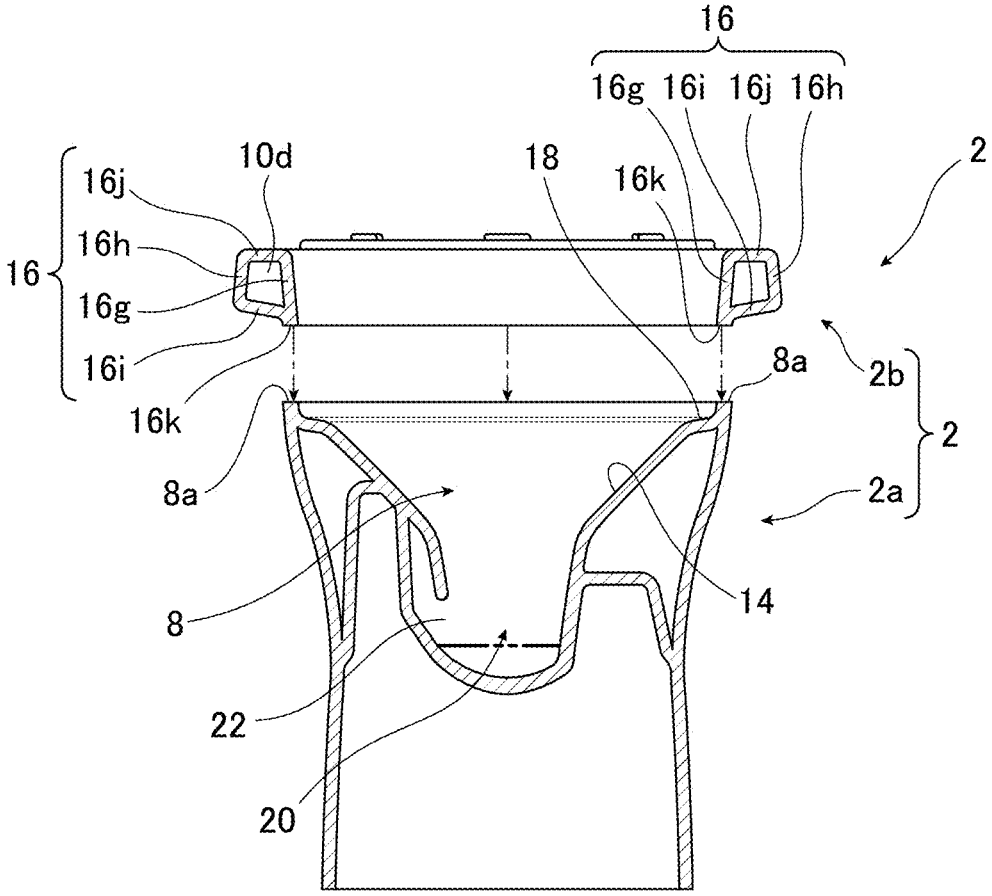
FIG. 13 is a front cross sectional view showing the flush toilet main body prior to an adhesion step in a flush toilet according to an embodiment of the present invention.

FIG. 12 is a side view showing the toilet main unit prior to the adhesive step in a flush toilet according to an embodiment of the present invention; FIG. 13 is a front cross sectional view showing the toilet main unit prior to the adhesive step in a flush toilet according to an embodiment of the present invention.

As shown in FIGS. 12 and 13, the ceramic toilet main unit 2 of the flush toilet 1 of the present embodiment is provided with a bottom toilet main unit 2*a* provided with a bowl portion 8 on which a waste receiving surface 14 and a shelf portion 18 are formed and from which a rim portion 16 is excluded, and a top side toilet main unit 2*b* provided with a rim portion 16, formed in advance separate from the bottom toilet main unit 2*a* at the time the toilet main unit 2 is manufactured, following which a bottom end portion 2*d* is adhered over the entire perimeter of the top end portion 2*c* of the bottom toilet main unit 2*a* in the adhesion step. This top side toilet main unit 2*b* is provided with a rim portion 16, which is adhered to the top end portion of the bowl portion 8 of the bottom toilet main unit 2*a*.

As shown in FIG. 13, the rim portion 16 of the top side toilet main unit 2*b* is provided with a rim inner wall portion 16*g* and a rim outer wall portion 16*h* respectively formed on the inner circumference and the outer circumference of the rim portion 16, a rim bottom surface portion 16*i* joining the two bottom end portions of the rim inner wall portion 16*g* and the rim outer wall portion 16*h*, and a rim top surface portion 16*j* joining the two top end portions of the rim inner wall portion 16*g* and the rim outer wall portion 16*h*, whereby the rim water conduit 10*d* is formed by the rim inner wall portion 16*g*, rim outer wall portion 16*h*, rim bottom surface portion 16*i*, and rim top surface portion 16*j*. By thus utilizing the space formed by the rim inner wall portion 16*g*, rim outer wall portion 16*h*, rim bottom surface portion 16*i*, and rim top surface portion 16*j* as a rim water conduit 10*d*, there is no need to erect a separate water conduit, and a simple structure may be adopted for the toilet main unit 2. The structure is even further simplified by forming the rim spouting port 26 on the rim inner wall portion 16*g*, which is at a front position on the bowl portion 8.

Figure 6:
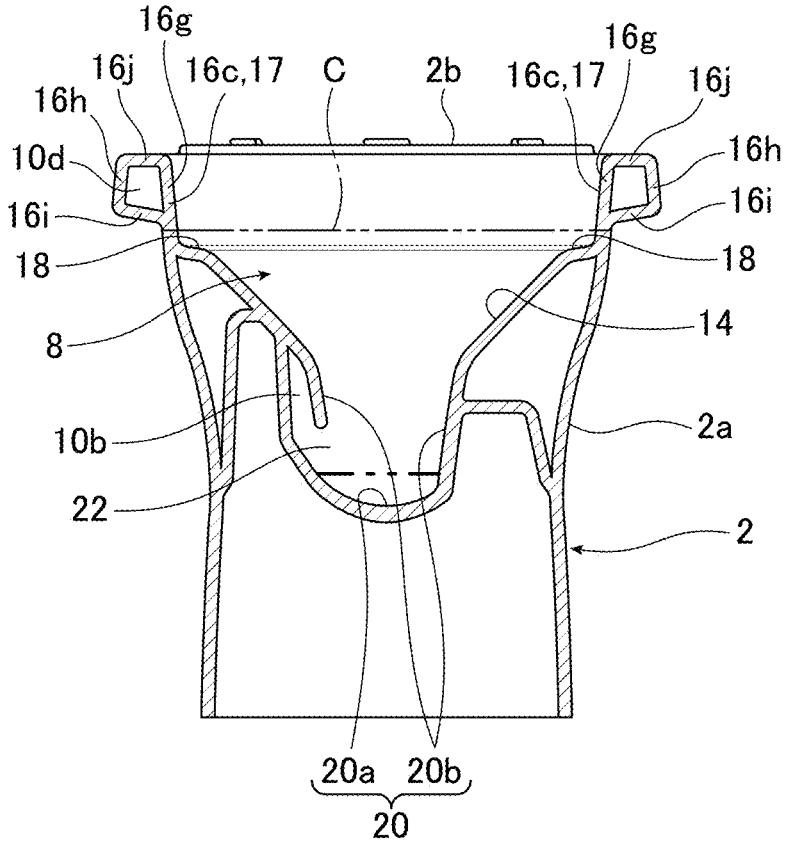
FIG. 6 is a cross sectional view seen along line VI-VI in FIG. 3.
Figure 7:
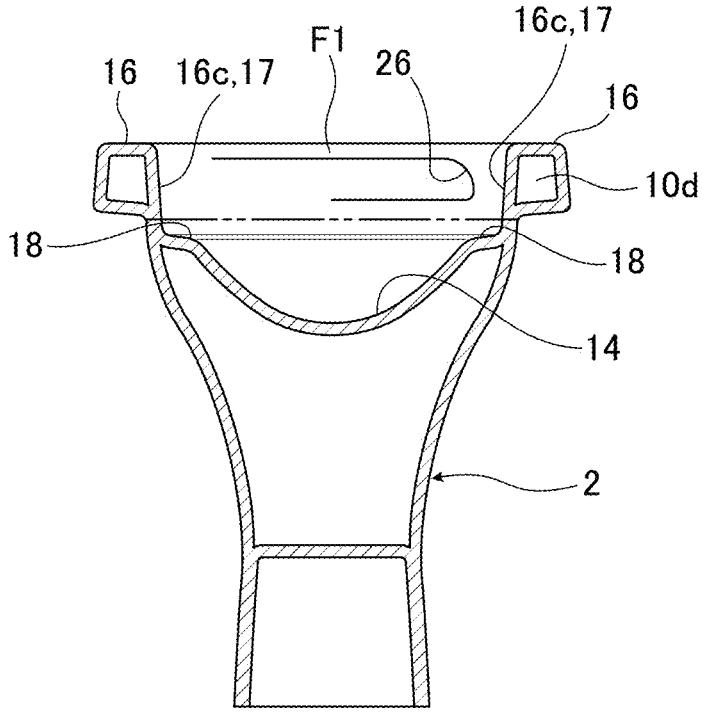
FIG. 7 is a cross sectional view seen along line VII-VII in FIG. 3.

In addition, FIGS. 6 and 10 show the toilet main unit 2 following the step in which the bottom toilet main unit 2*a* and the top side toilet main unit 2*b* are adhered, but the adhesion line C (border line) showing the adhesion portion between the bowl portion 8 part of bottom toilet main unit 2*a* excluding the rim portion 16 and the rim portion 16 of the top side toilet main unit 2*b* is positioned within the bottom region of the rim bottom surface portion 16*i* when seen in plan view from above. Therefore even if the adhesion line C, being the adhesion portion between the rim portion 16 and the bowl portion 8 excluding this rim portion 16, appears on the outer surface of the toilet main unit 2, this boundary line C is positioned within the bottom region of the rim bottom surface portion 16*i* when seen from above, and is therefore hidden by the rim bottom surface portion of the rim portion so that it cannot be seen, thereby improving the overall external aesthetic appeal of the toilet 1.

Also, as shown in FIGS. 6 and 13, with respect to the adhesion line C, being the adhesion portion between the bowl portion 8 in the bottom toilet main unit 2*a* and the rim portion 16 of the top side toilet main unit 2*b*, line contact between the top end portion 8*a* of the bowl portion 8 and the bottom end portion 16*k* of the rim inner wall portion 16*g* in the adhesion step forms a boundary line between the bowl portion 8 main unit and the rim portion 16, and this boundary line can be seen from the inside of the bowl portion 8 main unit and the rim portion 16. Thus when the rim portion 16 and the bowl portion 8 excluding the rim portion 16 are adhered at the time of manufacture of the toilet main unit 2, the boundary line (adhesion line C) formed by the line contact between the bottom end portion of the rim inner wall portion 16*g* and the top end portion 8*a* of the bowl portion 8 excluding the rim portion 16 is visible from inside the bowl portion 8, thereby facilitating the work of adhering the rim portion 16 and the bowl portion 8 excluding the rim portion 16 when the toilet main unit 2 is manufactured.

Next, referring to FIGS. 1 through 17, an operation of a flush toilet according to an embodiment of the present invention is described.

Figure 14:
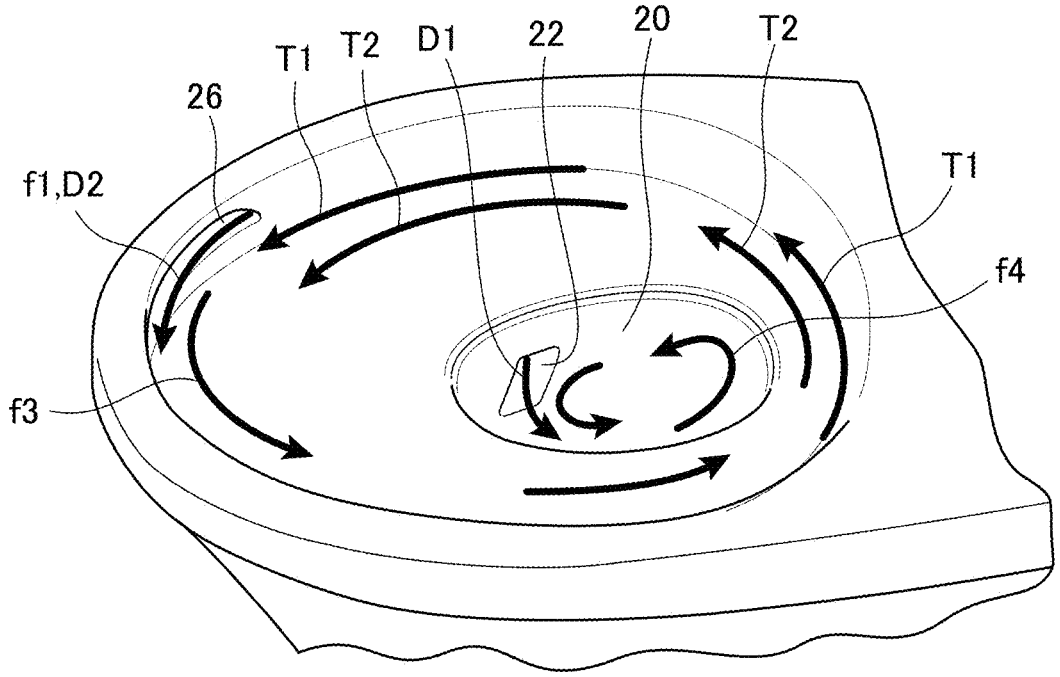
FIG. 14 is a perspective view explaining in schematic form the first circulation first swirl trajectory and the second circulation second swirl trajectory in the rim spout water when a rim cleaning is implemented after the start of jet cleaning of a flush toilet according to an embodiment of the present invention.

FIG. 14 is a perspective view explaining in schematic form the first circulation first trajectory and the second circulation second swirling trajectory by the rim spout water when a rim cleaning is implemented after the start of jet flushing in a flush toilet according to an embodiment of the present invention; FIG. 15 is a perspective view explaining in a schematic form the state whereby the swirling flow of rim spout water in a flush toilet according to an embodiment of the present invention flows downward into a concave portion.

First, toilet flushing is started when a user operates an operating lever (not shown) in order to flush the toilet, and flush water in the reservoir tank 6 flows through the shared water conduit 10*a*, branching into jet water conduit 10*b* and rim water conduit 10*d*. After spouting from the jet water spouting port 22 has started at the beginning, spouting from the rim spouting port 26 then begins at a delay. At this point, the water spouting direction D1 in the jet water spouting port 22 (arrow D1 in FIG. 14) is diagonally downward facing forward, and is essentially the same as the water spouting direction D2 in the rim spouting port 26 (arrow D2 in FIG. 14).

As shown in FIGS. 11 and 14, rim spout water spouted from the rim spouting port 26 flows to the front side along the inner circumferential surface of the rim portion 16, passes the vicinity of the front end portion 16*a* of the rim portion 16 where the curvature radius is smallest, and forms a flow (swirl flow f1) which swirls in a left rotation to the rear side of the rim portion 16, as well as forming a flow (falling flow f2) by which a part of the rim spout water falls down from the top end side of the rim portion 16. After the first circulation, rim spout water also forms a second circulation left rotation swirl flow f3 inside the first circulation swirl flow f1.

On the other hand, jet spouted water spouted diagonally downward toward the front (spouting direction D1) from the jet water spouting port 22 flows along the front side wall surface 20*b* and the bottom surface 20*a* on the front side within the concave portion 20, and after swirling as it rises diagonally upward from the bottom toward the rear side, forms a diagonal swirl flow f4, which swirls along the rear side wall surface 20*b* within the concave portion 20. This diagonal swirl flow f4 forms a left-rotation swirl flow when the concave portion 20 is seen in plan view from above; the swirl direction of the rim-spouted water and the swirl direction of the jet-spouted water are the same (left-rotating) when seen in plan view.

As shown in FIG. 14, the first swirl trajectory T1 at the time flush water spouted from the rim spouting port 26 is swirling in the first circulation swirl flow f1 along the rim portion 16 is positioned above and outside the second swirl trajectory T2 at the time of swirling by the second circulation swirl flow f3 along the rim portion 16 and shelf portion 18 after the first circulation swirl is ended in this first circulation first swirl trajectory T1.

Next, as shown in FIG. 14, rim spout water flows down within the concave portion 20 along the waste receiving surface 14 while for the most part maintaining its force in the direction of the left-rotating swirl flow; it then merges with the swirl flow of the jet spout water in the concave portion 20 and produces a diagonal swirl flow f4 with a comparatively strong and fast rotational force in the concave portion 20.

Figure 15:
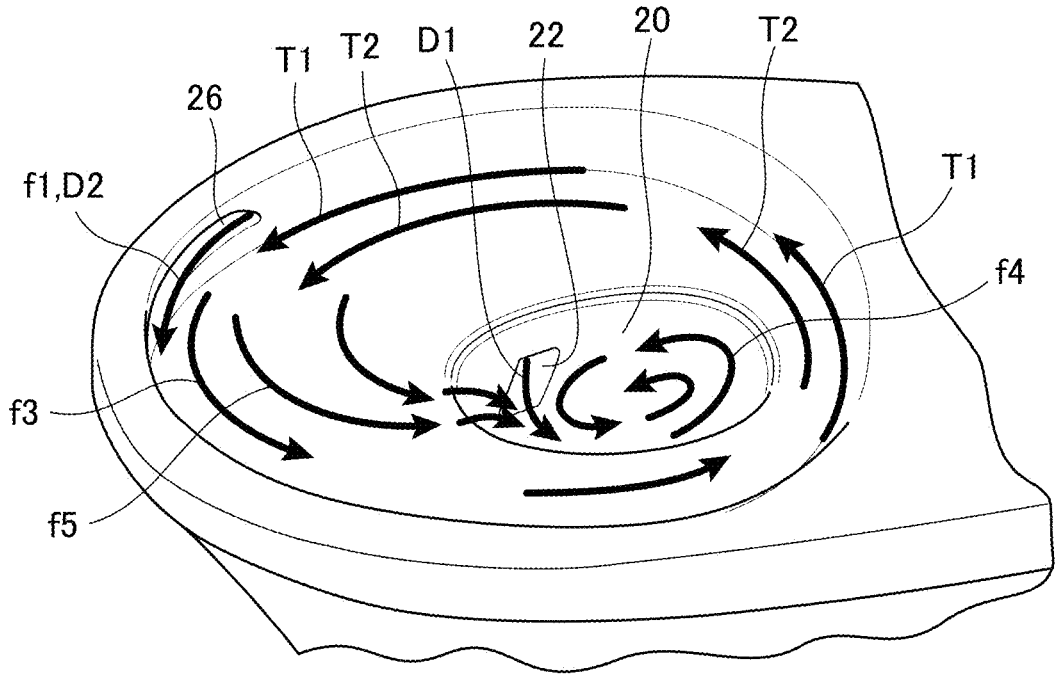
FIG. 15 is a perspective view explaining in a schematic manner the state whereby the swirling flow of rim spout water in a flush toilet according to an embodiment of the present invention flows downward into a concave portion.

Also, as shown in FIG. 15, new rim spouting continues to occur from the rim spouting port 26 after the rim spout water merges with the diagonal swirl flow f4 of the jet spouted water in the concave portion 20, and as the volume of rim spout water swirling on the waste receiving surface 14 increases, the swirl flow f5 of rim spout water at increased flow force flows down and merges toward the diagonal swirl flow f4 of jet spout water in the concave portion 20, forming a flow by which waste in the concave portion 20 is strongly pushed toward the inlet port 12*a* of the water discharge trap pipe 12.

Finally, the comparatively strong rotational force of the diagonal swirl flow f4 in the concave portion 20 after merging with the rim spout water enables high specific gravity waste to be pushed into the water discharge trap pipe 12 from the bowl portion 8, and enables low specific gravity floating waste to be sent into the water discharge trap pipe 12 from the bowl portion 8 by the comparatively fast post-merge rotating diagonal swirl flow f4.

Figure 16A:
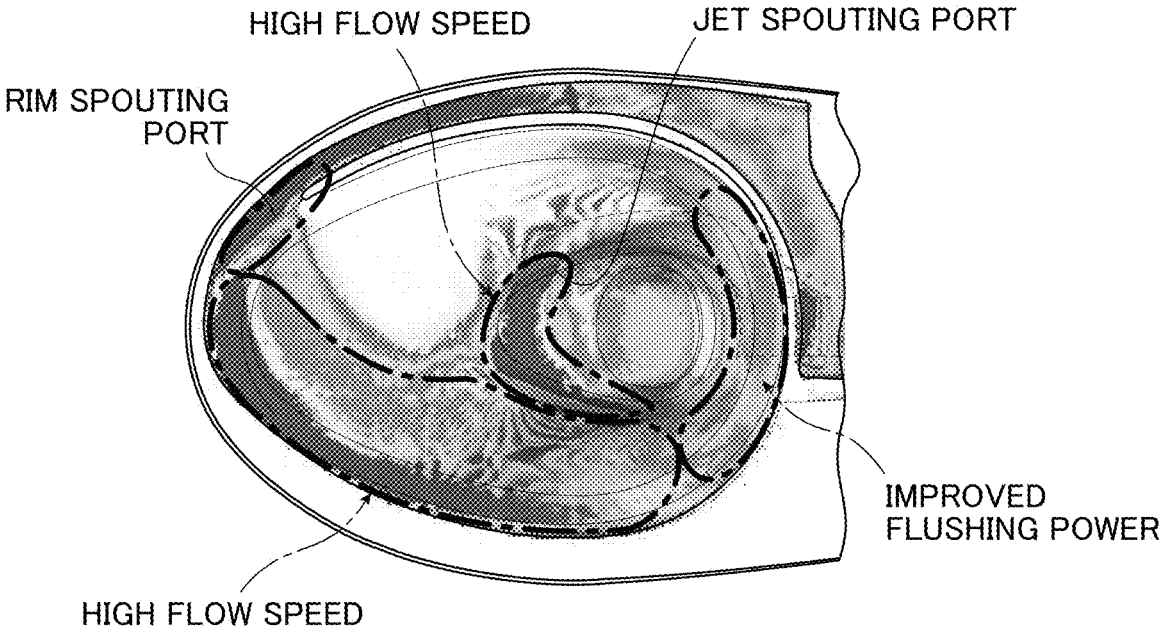
FIG. 16(*a*) is an example of the results of an analysis of the distribution of flow rates in the rim spout water and the jet spout water when a toilet is flushed using a flush toilet according to an embodiment of the present invention, and FIG. 16(*b*) shows the results of an analysis of flow rate distribution for rim spout water and jet spout water when a toilet is flushed using a conventional flush toilet, as a comparative example relative to the analytic results shown in FIG. 16(*a*)
Figure 16B:
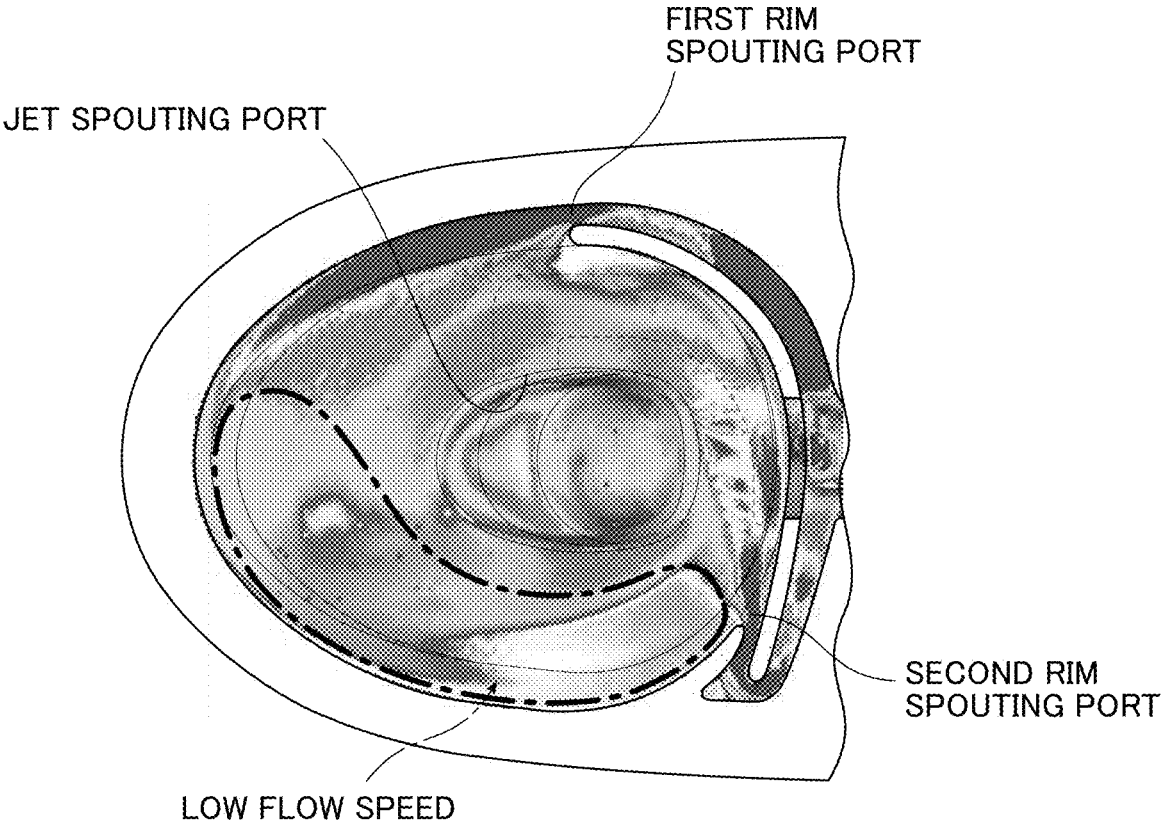

Next, FIG. 16(*a*) shows an example of the results of a flow speed distribution analysis of rim spout water and jet spout water when a toilet is flushed using a flush toilet according to an embodiment of the present invention; FIG. 16(*b*) shows, as a comparative example relative to the analytic results shown in FIG. 16(*a*), the results of a flow speed distribution analysis of rim spout water and jet spout water when flushing a conventional toilet.

The shading of the flush water shown in FIG. 16 indicates the extent of the flush water flow speed; when the toilet main unit 2 of the flush toilet 1 in the above-described embodiment is seen from above, a comparatively large flush water flow speed is obtained from the rim spouting port in the bowl portion, passing the rim portion front end, up to the rear region in which it swirls in left rotation, and in the vicinity of the jet water spouting port of the concave portion and the region in front of same.

In contrast, the flush toilet in the comparative example shown in FIG. 16(*b*) differs from the form of the flush toilet 1 in the present embodiment, and is a form in which two rim spouting ports (first and second rim spouting ports) are provided in the region on the rear side of the rim portion, and a jet spouting port is provided on the side wall surface on one side of the concave portion within the bowl portion, but in the region from the rim portion front end in the bowl portion to the vicinity of the rear side second rim spouting port, the flow speed of the flush water is comparatively small compared to the flush toilet 1 of the present embodiment, so it is apparent that the flushing power of the flush toilet of the present embodiment is improved compared to a conventional flush toilet.

Figure 17A:
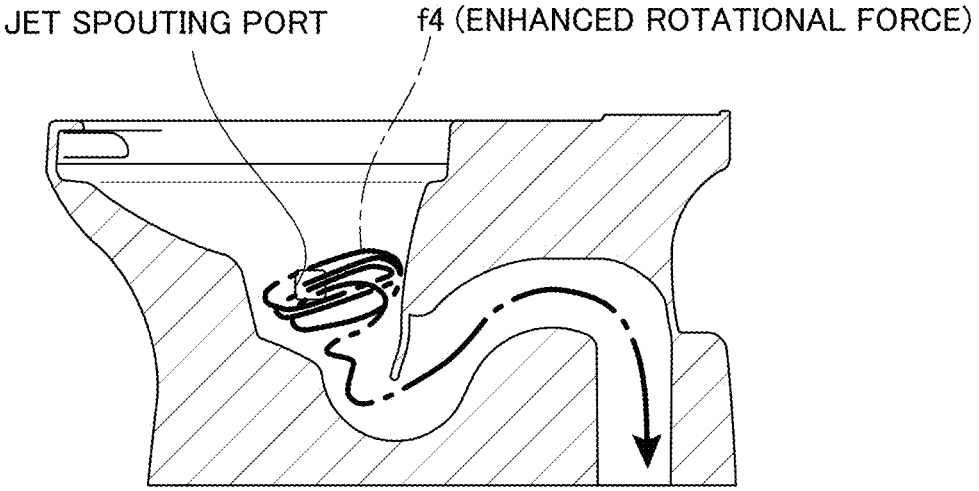
FIG. 17(*a*) is an example of the results of an analysis of the distribution of flow rates in the jet spout water and the appearance of the flow when a toilet is flushed using a flush toilet according to an embodiment of the present invention.
Figure 17B:
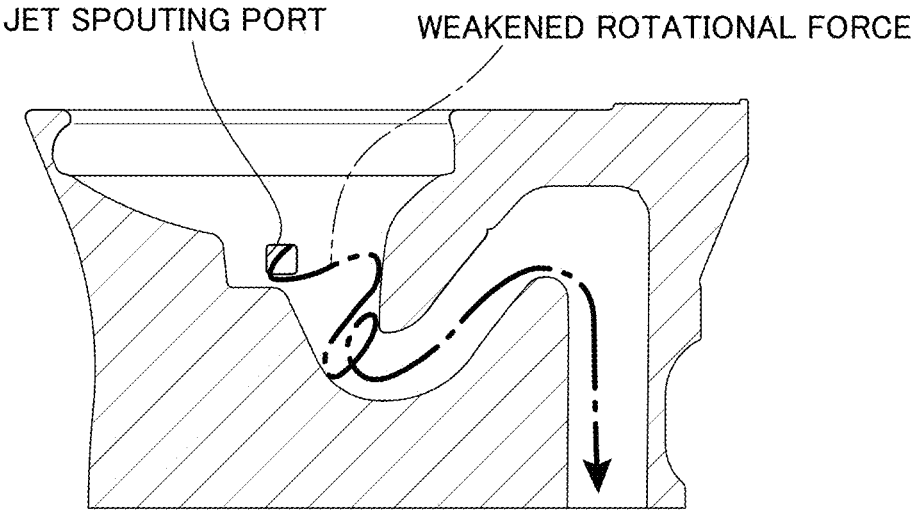

Next, FIG. 17(*a*) shows an example of the results of an analysis of flow speed distribution and the appearance of flow of jet spout water when a toilet is flushed using a flush toilet according to an embodiment of the present invention; FIG. 17(*b*) shows, as a comparative example relative to the analytic results shown in FIG. 17(*a*), the results of an analysis of jet flow water speed distribution and the appearance thereof when a toilet is flushed using a conventional flush toilet.

First, the shading of the flow lines in the flush water shown in FIG. 17(*a*) indicates the degree of flush water flow force, but it is apparent that when the toilet main unit 2 of the flush toilet 1 of the above-described present embodiment is viewed from the side, jet spout water spouted diagonally downward facing forward from the jet spouting port on the concave portion of the bowl portion flows along the front side wall surface and bottom surface in the concave portion, and swirls as it rises diagonally upward from below facing the rear side, after which it forms a diagonal swirl flow f4 which swirls along the wall surface on the rear side in the concave portion and diagonally downward.

In contrast, the flush toilet of the comparative example shown in FIG. 17(*b*) is of the same form as the flush toilet in the comparative example shown in FIG. 16(*b*), and the jet spout water spouted from the jet spouting port forms a flow which falls to the bottom surface of the concave portion after being spouted toward the side wall surface of the concave portion opposite the jet spouting port. Therefore the flow speed and rotational force of the swirl flow in the concave portion of the flush toilet of the comparative example is weakened and the flow pushing into the discharge trap pipe is reduced compared to the flow speed and rotational force of the strong diagonal swirl flow f4 in the front region F of the present embodiment shown in FIG. 17(*a*), making it apparent that waste discharge performance is improved in the flush toilet of the present embodiment compared to a conventional flush toilet.

According to the flush toilet 1 of the above-described embodiment of the present invention, the rim spouting port 26 for spouting flush water onto the shelf portion 18 of the bowl portion 8 and forming a swirl flow f1 is formed in the front region F2 of the bowl portion 8 and is offset from the easily dirtied rear side region R of the bowl portion 8, making it difficult for waste to adhere to the rim spouting port 26 and its vicinity; furthermore, because the rim spouting port 26 is covered by the overhanging part 16*b* of the rim portion 16, the user cannot see it when viewing from diagonally forward and above the bowl portion 8, therefore the user's perception of cleanliness can be improved, as can the aesthetic appeal of the bowl portion 8 as a whole.

According to the flush toilet 1 of the present embodiment, the rim spouting port 26 is formed in the vicinity of the front edge portion 16*a* of the rim portion 16, and the overhanging part 16*b* of the rim portion 16 covers the rim spouting port 26, therefore the user cannot visibly perceive the rim spouting port 26, and the user's perception of cleanliness is improved, as is the aesthetic appeal of the bowl portion 8 as a whole. Furthermore, the overhanging part 16*b* of the rim portion 16 is formed to be left-right symmetrical in the vicinity of the inner circumferential side front edge portion

16*a* of the rim portion 16 of the bowl portion 8, thus enabling the overall aesthetic appeal of the bowl portion 8 to be improved.

In addition, according to the flush toilet 1 of the present embodiment the rim spouting port 26 is formed on the top end side of the rim portion 16 of the bowl portion 8, therefore to a user viewing the bowl portion 8 from diagonally forward and above, the rim spouting port 26 falls squarely into the blind angle of the overhanging part 16*b* of the rim portion 16, making it difficult for the user to see the rim spouting port 26. The users perceived sense of cleanliness can be improved, as can the aesthetic appeal of the bowl portion 8 as a whole.

Furthermore, according to the flush toilet 1 of the present embodiment, the rim spouting port 26 is hidden by the overhanging part 16*b* of the rim portion 16, therefore the rim portion 16 can be made left-right symmetrical over the broad region visible by a user from diagonally forward and above the bowl portion 8. As a result, the present invention enables the aesthetic appeal of the overall bowl portion 8 to be improved.

In addition, according to the flush toilet 1 of the present embodiment, the majority of the rear region R of the rim portion 16 of the bowl portion 8 forms part of a true circle having a predetermined radius, therefore when a user views it from diagonally forward and above, the majority of the most prominent rear region R of the rim portion 16 of the bowl portion 8 forms part of a true circle of a predetermined radius (curvature radius ρ3), therefore the aesthetic appeal of the overall bowl portion 8 can be improved.

Furthermore, according to the flush toilet 1 of the present embodiment, the rim spouting port 26 is formed in the vicinity of the front edge portion 16*a* of the rim portion 16 of the bowl portion 8, and in the vicinity of the inner circumferential side front edge portion 16*a* of the rim portion 16, the inner circumferential surface 17 of the rim portion 16 forms an indented space B protruding forward on the shelf portion 18 comprised of the vertical surface 17*a* and the horizontal surface 17*b* extending inward from this vertical surface 17*a*; within the indented space B, the rim spouting port 26 and the vertical surface 17*a* of the rim portion 16 are continuously formed so as to be flush, making it difficult for the user to see the rim spouting port 26 when viewed from diagonally forward and above the bowl portion 8, so that the user's perceived sense of cleanliness is improved. The aesthetic appeal of the bowl portion 8 as a whole is also improved.

Note that in the flush toilet 1 of the above-described embodiment, a flush toilet of the wash-down type is explained as an example, but the flush toilet may also be a siphon-type of flush toilet in which the siphon effect is utilized to draw in waste in the bowl portion and discharge it all at once from a discharge trap pipe.

Furthermore, in the flush toilet 1 of the above-described present embodiment, it is explained a form whereby jet spouting is performed using a jet water conduit 10*b* and a jet water spouting port 22, and rim spouting is performed using a rim water conduit 10*d* and a rim spouting port 26, but the present invention is not limited thereto, and may also be applied to a form in which jet spouting by the jet water conduit 10*b* and the jet water spouting port 22 is omitted, and only rim spouting by the rim water conduit 10*d* and the rim spouting port 26 is performed.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet for discharging waste using flush water supplied from a flush water source, the flush toilet comprising:

a bowl portion including a bowl-shaped waste receiving surface, a rim portion having an inner circumferential surface formed on a top edge portion of the bowl portion so that the inner circumferential surface rises essentially vertically, and a shelf portion formed continuously between a lower end of the inner circumferential surface of the rim portion and an upper end of the waste receiving surface;

a water discharge path for discharging the waste, the path including an inlet which is connected at a bottom of the bowl portion;

a water spouting portion consisting of a single spouting port which spouts flush water toward a front end of the bowl portion onto the shelf portion and the inner circumferential surface of the rim portion so as to form a swirl flow in one direction along the shelf portion and the inner circumferential surface of the rim portion; and a water conduit for supplying the flush water to the spouting portion;

wherein the spouting port of the water spouting portion spouting flush water toward the front end of the bowl portion is formed in either one of a right side and a left side in a front region of the bowl portion which is a front side from a center line extending transversely located at a center equidistant from the front end and a rear end of the bowl portion, the spouting port of the water spouting portion is located at an upstream area from the front end of the bowl portion in the front region of the bowl portion so that the spouted water flows on the upstream area from the front end of the bowl portion, the front end of the bowl portion, and an downstream area from the front end of the bowl portion, a part of the inner circumferential surface of the rim portion in the front region of the bowl portion is formed in an inward-facing overhanging shape, and an indented space is formed downstream from the spouting port by the circumferential surface having the overhanging shape of the rim portion and the shelf portion in the front region of the bowl portion and the indented space is further formed so as to protrude forward from a virtual surface which extends vertically between an inner end of the overhanging shape of the rim portion and the shelf portion in the front region of the bowl portion;

the spouting port of the water spouting portion is located in the indented space in the front region of the bowl portion, and covered by an overhanging part of the rim portion such that a user located in front of the flush toilet cannot observe the water spouting portion when viewing from diagonally forward and above the bowl portion;

the inner circumferential surface of the rim portion includes a vertical surface, and in the indented space, the spouting port of the water spouting portion and the vertical surface of the rim portion are continuously formed so as to be flush; and wherein the front region of the bowl portion includes:

a first front region which includes the front end of the inner circumferential surface of the rim portion and is disposed from one end side to the other end side opposite to the one end side and symmetrically relative to a dividing line that equally divides the bowl portion in a left-right direction in a plan view;

a second front region which is formed on an upstream side rearward from the one end side of the first front region and on a front side of the water conduit, and including the spouting port; and a third front region which is formed on a downstream side rearward from the other end side of the first front region;

wherein the first front region has an upstream end and a downstream end, the first front region including the front end of the rim portion and having a smallest constant curvature radius of an entire perimeter of the rim portion, wherein the spouting port is formed on a part of the second front region, where a curvature radius of the rim portion changes from a larger curvature radius to a smaller curvature radius in a direction where the flush water is supplied, wherein the spouting port extends to the upstream end of the first front region at a downstream end of the spouting port, wherein the overhanging part of the rim portion includes:

an upstream overhanging part which is formed from the dividing line to a rear end of the second front region in the plan view; and a downstream overhanging part which is formed from the dividing line to a rear end of the third front region in the plan view; and wherein the upstream overhanging part and the downstream overhanging part are disposed asymmetrically to each other with respect to the dividing line in the plan view, and a first area in the plan view of the upstream overhang part is larger than a second area in the plan view of the downstream overhang part.

2. The flush toilet according to claim 1, wherein the water spouting portion is formed in the vicinity of a front end of the rim portion of the bowl portion, and the overhanging part of the rim portion is formed to be left-right symmetrical in the vicinity of the front end of the rim portion of the bowl portion so as to cover the water spouting portion.

3. The flush toilet according to claim 2, wherein the water spouting portion is formed above the shelf portion by a predetermined height on a top end side of the rim portion of the bowl portion.

4. The flush toilet according to claim 1, wherein the majority of a rear region of the rim portion of the bowl portion which is a rear side from the center line extending transversely located at the center equidistant from the front and rear ends of the bowl portion, forms part of a true circle having a predetermined radius.

5. The flush toilet according to claim 1, wherein the spouting port is formed in the vicinity of a front end of the rim portion of the bowl portion; in the vicinity of the front end of the rim portion, the inner circumferential surface of the rim portion is formed in an overhanging shape of a vertical surface and a horizontal surface extending inward from the vertical surface; and the indented space protruding forward in the vicinity of the front end of the rim portion is formed on the shelf portion by the vertical surface and horizontal surface.

6. The flush toilet according to claim 1, wherein the shelf portion continuously extends across the front end of the bowl portion.

* * * * *